US008061549B2

(12) United States Patent
Nyeboer et al.

(10) Patent No.: US 8,061,549 B2
(45) **Date of Patent: *Nov. 22, 2011**

(54) DUNNAGE STRUCTURE MADE WITH MULTIPLE PLY PARTITIONS

(75) Inventors: Calvin D. Nyeboer, Holland, MI (US); Michael F. Stejskal, Holland, MI (US)

(73) Assignee: Bradford Company, Holland, MI (US)

( * ) Notice: Subject to any disclaimer, the term of this patent is extended or adjusted under 35 U.S.C. 154(b) by 488 days.

This patent is subject to a terminal disclaimer.

(21) Appl. No.: 12/235,695

(22) Filed: Sep. 23, 2008

(65) Prior Publication Data

US 2010/0072085 A1 Mar. 25, 2010

(51) Int. Cl.
*B65D 1/24* (2006.01)
*B65D 25/04* (2006.01)
*B65D 81/02* (2006.01)

(52) U.S. Cl. ..... 220/552; 220/507; 229/120.36; 206/523

(58) Field of Classification Search ..... 220/529, 220/535, 552, 553, 507, 555, 556, 4.26, 4.27, 220/652, 676, 677, 530, 538, 539, 541, 542, 220/545, 557, 550, 549, 4.28, 500, 62.11, 220/FOR. 156, FOR. 127, FOR. 180, FOR. 176, 220/FOR. 165; 229/125.29, 190, 191, 122.2, 229/915–919, 120.36, 102.01, 120.37; 206/175, 206/821, 503–513, 523, 583; 211/188, 194
See application file for complete search history.

(56) References Cited

U.S. PATENT DOCUMENTS

| | | | | |
|---|---|---|---|---|
| 2,647,679 | A | 8/1953 | Schilling et al. | |
| 3,399,098 | A | 8/1968 | Omoto et al. | |
| 3,487,479 | A | 1/1970 | Grooms | |
| 3,647,607 | A | 3/1972 | Hillers | |
| 3,859,161 | A | 1/1975 | McLeod | |
| 3,873,407 | A | 3/1975 | Kumata et al. | |
| 3,921,891 | A | 11/1975 | Gorham | |
| 4,127,304 | A | 11/1978 | Gardner | |
| 4,141,486 | A * | 2/1979 | Nilsen | 229/198.1 |
| 4,224,376 | A | 9/1980 | Ishige et al. | |
| 4,375,263 | A | 3/1983 | Dworkin | |
| 4,898,640 | A | 2/1990 | O'Connor | |
| 5,732,876 | A | 3/1998 | Bradford | |
| 5,788,146 | A | 8/1998 | Bradford et al. | |
| 5,876,813 | A | 3/1999 | Bambara et al. | |
| 5,882,776 | A | 3/1999 | Bambara et al. | |
| 5,938,878 | A | 8/1999 | Hurley et al. | |
| 6,054,005 | A | 4/2000 | Hurley et al. | |
| 6,167,790 | B1 | 1/2001 | Bambara et al. | |
| 6,375,779 | B1 | 4/2002 | Melquist et al. | |
| 6,416,854 | B2 | 7/2002 | Hunter, Jr. | |
| RE38,707 | E | 3/2005 | Merkel | |
| 7,344,043 | B2 | 3/2008 | Nyeboer | |
| 2004/0118854 | A1 | 6/2004 | Kutun | |
| 2006/0157489 | A1 * | 7/2006 | Bradford et al. | 220/552 |

FOREIGN PATENT DOCUMENTS

| | | | |
|---|---|---|---|
| JP | 404065235 | A | 3/1992 |

* cited by examiner

*Primary Examiner* — J. Gregory Pickett
*Assistant Examiner* — Andrew Perreault
(74) *Attorney, Agent, or Firm* — Wood, Herron & Evans, LLP

(57) ABSTRACT

A dunnage structure comprising a partition matrix made up of at least some folded partitions, each of the folded partitions having two plies fused together in select locations. The partitions may be made by folding a partition blank and securing at least one portion of the folded partition blank to itself. Passages extend through portions of the folded partitions to allow multiple partitions to be secured together using connectors extending through the passages.

18 Claims, 23 Drawing Sheets

DUNNAGE STRUCTURE MADE WITH MULTIPLE PLY PARTITIONS

FIELD OF THE INVENTION

The present invention relates to a dunnage structure for dividing the space inside a container; more particularly to a multiple ply partition for use in such a dunnage structure.

BACKGROUND

In the storage, shipment or display of parts or merchandise, it is a common practice to divide the interior of a box or container into a plurality of individual cells. The interior of a box or container is typically separated by a series of dividers, one set of parallel dividers being orthogonal to a second set of dividers. The dividers separate the interior of the container into a plurality of individual holding cells each of which is intended to hold a separate item for display and/or shipment. The division of the interior of the box or container helps prevent the items therein from contacting one another and breaking during shipping. The division or partitioning of the container also aids in the loading and unloading of the items therein, as well as inventorying the contents of each box or container.

The dividers typically are slotted and arranged in an orthogonal relationship to divide the interior of the box or container into a desired number of holding cells. The dividers are slotted in a manner that enables the dividers to engage with one another at the location of the slots so that the dividers form an orthogonal grid or matrix. Typically the dividers are made of the same material as the material of the box or container, plastic or paperboard. However, the dividers may be constructed of any suitable material with sufficient rigidity to prevent the contents of the container from contacting one another and being damaged.

One disadvantage with known partition assemblies is that the upper edges of the partitions may have exposed sharp edges. For example, corrugated plastic partitions may have sharp upper edges created by cutting a sheet of corrugated plastic to the desired partition size. Such an exposed upper edge of the partition may damage products or parts being loaded into or unloaded from the cells of the container in which is located the partition matrix or assembly. Partition assemblies incorporating partitions having exposed sharp upper edges may require additional clearance between the parts being either loaded or unloaded and the upper edges of the partitions.

Another disadvantage of such partition assemblies is that the person loading or unloading parts or products into or from the cells of the container may cut or scrape their knuckles or hands on the exposed edges of the partitions when loading or unloading parts or products.

Additionally, the stiffness of the partitions of the assembly is dictated by the material from which the partitions are made. The stiffness of the partitions may not be altered without changing the material from which the partition is made.

U.S. Pat. No. 2,647,679 discloses a partition assembly which separates the interior of a box or container into a plurality of cells. The partitions of the assembly disclosed in this patent are formed by folding a blank of material along a fold line so as to create a rounded smooth upper edge. The material is disclosed as being paper board or similar material.

Another partition assembly for dividing the interior of a container is disclosed in U.S. Pat. No. 4,375,263. The partitions of this assembly are similarly rounded along their upper edges and are made of transparent vinyl sheets.

In each of these prior art partition assemblies, the opposed plies of the dividers or partitions formed by folding a blank of material are not secured to each other. Consequently, the opposed sides or plies of the partitions are not secured to each other and may be easily separate, thereby expanding into the cells of the container defined by the partition assembly. Consequently, the partitions may contact the products or parts stored in the cells and damage them. Additionally, the partition plies may easily tear or otherwise be damaged. Upon assembly or disassembly of the partition matrix, one or more portions of the partitions may tear and hence cause disassembly of at least a portion of the partition matrix.

It therefore has been one objective of the present invention to provide a double-ply partition for use in a dunnage structure in which the plies are secured together in predetermined locations and have passages for joining multiple partitions together.

It has been a further objective of the invention to provide a method of manufacturing a dunnage structure incorporating at least some multiple-ply partitions and connectors which pass through the interior of the multiple-ply partitions.

It has been another objective of the present invention to provide a dunnage structure which may be quickly and easily assembled for use in a container.

SUMMARY OF THE INVENTION

The dunnage structure of the present invention comprises a plurality of multiple-ply partitions, at least one of the multiple-ply partitions having passages extending through the partition and comprising opposed plies fused together at predetermined select locations. In some embodiments, the dunnage structure comprises additional partitions which may or may not be multiple-ply partitions. The term multiple-ply means two or more ply or layers, the passages may be between any two adjacent layers.

In one embodiment, the multiple-ply partitions are vertically oriented and the additional partitions are horizontally oriented. The additional partitions have openings therethrough which allow connectors to pass therethrough. The connectors also pass through passages in the multiple-ply partitions and may be secured at the top and/or bottom of the dunnage structure to one or more partitions or other form of anchor. If desired, the horizontally oriented partitions may be multiple-ply partitions. The vertically and horizontally oriented partitions together form a plurality of holding cells into which different parts are stored for shipment or display. The partitions are joined together with a plurality of connectors which extend through passages of at least some of the multiple-ply partitions and through openings or slots in additional partitions.

In some embodiments, multiple-ply partitions may be both vertically and horizontally oriented. Some or all of the partitions may have one or more rounded edges.

According to one aspect of the invention, at least one partition is formed of a multilayered material folded in half and secured to itself at select or predetermined locations. The fold creates a rounded edge at the fold line which is smooth and has a continuous surface with the outer side walls or skins of the partition. The partition comprises an inner layer of foam, preferably polyolefin foam, and an outer layer, skin or facegood. The opposed plies of the partition are fused or parent welded to each other at select or predetermined locations using only heat without any additional material required. Along the passages of the partition, the opposed plies are not secured to each other, allowing a connector to pass between the opposed plies of the partition. In this manner, the opposed plies of the partition are partially fused or joined together without any additional material such as glue.

In one embodiment, the inner foam layer is bonded directly or laminated to the outer layer. The outer layer may be made of woven polyester, non-woven polypropylene, foamed or solid polyolefin or other material such as latex or non-polyolefin plastic. The outer layer may be selected as appropriate to protect or prevent surface damage to the products being stored and/or shipped in the cells of the container.

In an alternative embodiment, a desired stiffness or rigidity may be created in the partition by inserting into the partition blank from which the partition is made a thin plastic skin or middle layer between the inner foam layer and the outer layer or facegood. By altering the thickness and/or mechanical properties of this middle layer, or by omitting it altogether, the desired level or degree of stiffness of the partition may be achieved during the manufacturing process.

In an alternative embodiment, the partition may be made solely of one foam layer without any outer layer or facegood.

The method of making a multiple-ply partition by securing select portions of opposed plies of the partition together is quick, easy and inexpensive. Portions of the opposed plies of the partition are secured or fused to each other, making the partition non-disassembling and enhanced by being double layered or double ply without using any additional material or tools. Other portions of the opposed plies of the partition are not secured to each other and define passages adapted to receive and retain the connectors used to join together multiple partitions.

A dunnage structure incorporating one or more multiple-ply partitions having passages may be quickly and easily formed by passing one or more connectors through the passages of multiple partitions and through openings in additional partitions. The next step may comprise securing opposed ends of the connectors to partitions or anchors which may be a top or bottom of the dunnage structure or any similar type device or structure. In some applications, the connectors need not be secured to any structure; friction may sufficiently hold them in place. The dunnage structure of this invention may be used in a horizontal dispensing container or any other similar shipping container such as a metal rack, for example. The present invention is not intended to limit the type of container in which such a dunnage structure may be used.

According to one aspect of the invention the dunnage structure comprises a plurality of multiple-ply partitions, at least one of the partitions having passages extending through the partition and comprising opposed plies fused together at select locations. Connectors extend through the passages of the partitions. In some embodiments, at least one of the partitions has a foam interior portion. In some cases, the foam interior portion is polyolefin foam. In some embodiments, at least one of the partitions has a rounded edge.

The dunnage structure further may comprise a plurality of additional partitions. In some cases the additional partitions are multiple-ply partitions. In some cases at least some of the additional partitions have a rounded edge.

According to another aspect of the invention the dunnage structure comprises a plurality of partitions, at least some of the partitions having a rounded edge and comprising opposed plies at least partially fused together and having passages extending through the partition. In such a dunnage structure connectors extend through the passages of the partitions, joining multiple partitions together. Some of these partitions have a foam interior portion and an outer slain secured to the foam interior portion. The foam interior portion may be multiple-ply. Such a dunnage structure further comprises a plurality of additional partitions. The additional partitions may be plastic and/or horizontally oriented and/or have a rounded edge. The partitions comprising opposed plies at least partially fused together may be vertically oriented. The connectors may be plastic including nylon, metallic such as steel or aluminum or any other desired material.

According to another aspect of the invention the dunnage structure comprises a plurality of folded partitions, each of the folded partitions having a rounded edge and comprising opposed plies at least partially fused together and an outer face surrounding a foam interior. Such a partition has passages extending through the partition and connectors extending through the passages of the partitions, joining multiple partitions together. The outer face of each of the folded partitions may comprise a woven polyester. The foam interior may be a polyolefin foam. The dunnage structure further comprises a plurality of additional partitions which may be plastic and folded or not folded.

According to another aspect of the invention the dunnage structure comprises a plurality of horizontally oriented partitions and a plurality of vertically oriented partitions, at least some of the partitions comprising opposed plies at least partially fused together and having passages extending through the partition. The dunnage structure further comprises connectors extending through the passages of the partitions, joining multiple partitions together. At least some of the horizontally oriented partitions may have a rounded edge. At least some of the vertically oriented partitions may have a rounded edge. The partitions comprising opposed plies may be at least partially fused together and vertically oriented. The connectors may be plastic including nylon, metallic such as steel or aluminum, fiberglass, paperboard or any other desired material.

DETAILED DESCRIPTION OF THE DRAWINGS

Figure 1:
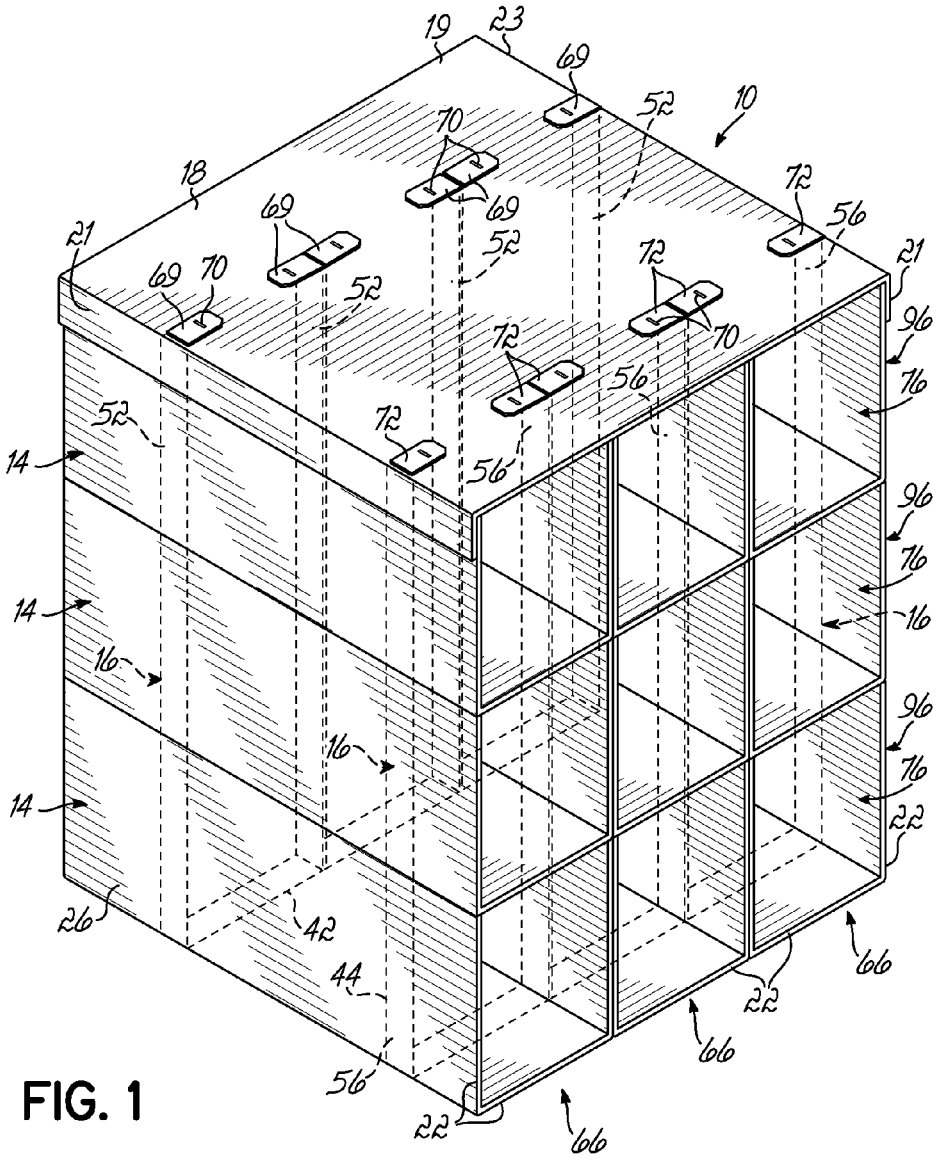
FIG. 1 is a perspective view of one embodiment of dunnage structure of the present invention in an assembled condition.

Referring to the drawings and particularly to FIG. 1, there is illustrated a dunnage structure 10 for dividing the space inside a container. The dunnage structure 10 may be used in any container and in particular any horizontal dispensing container including a metal rack like the ones shown in FIGS. 5 and 6. Alternatively, the dunnage structure may be used in a container known in the industry as a Redi-Rack® shown in FIGS. 7 and 8. The present invention is not intended to be limited for use in any one style or type of container.

As illustrated in FIG. 1, one embodiment of dunnage structure 10 comprises a plurality of partition trays 14 joined together with connectors 16 and a top 18. For purposes of this document, the term "tray" is not intended to be limited to any dictionary definition or the exact "tray" shown in the drawings. The term "tray" is intended to mean any partition folded and formed into a structure having a bottom and two opposed side walls. Similarly, the term "dunnage structure" is not intended to be limited to any embodiment shown or described herein, but rather is intended to mean any number of pieces or parts held or put together for separating and protecting products for shipment.

Figure 2:
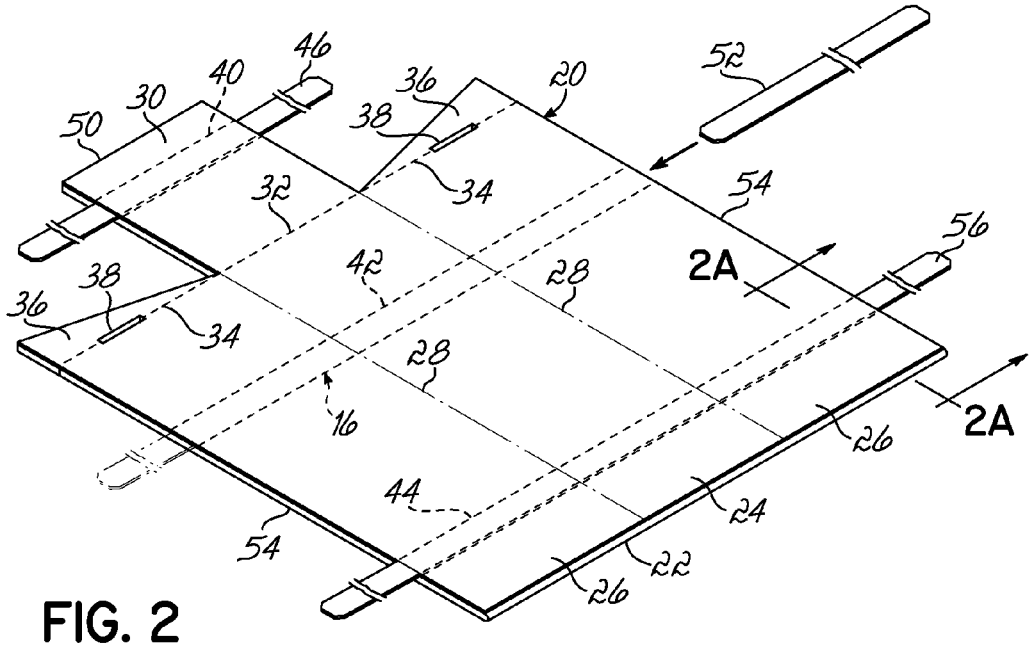
FIG. 2 is a perspective view of a blank used to form a folded partition for use in the dunnage structure of FIG. 1 with connectors.

As shown in FIG. 2, in one embodiment, each tray 14 is formed from a multiple-ply partition 20 having a rounded front edge 22. As shown in FIG. 2, the partition 20 has a middle portion 24 and two opposed side portions 26, the middle portion 24 being separated from the side portions 26 by parallel fold lines 28. The partition 20 has a generally rectangular rear portion 30 separated from the remainder of the middle portion 24 by a fold line 32. The partition 20 has additional fold lines 34 which may be omitted, if desired. Two aligned slots 38 are aligned with fold lines 34. Each slot 38 extends through the partition 20. Two generally triangular locking portions 36 are located behind the slots 38 and fold lines 34, as shown in FIG. 2. The partition 20 may be other shapes or sizes and is not intended to be limited to the configuration shown in FIG. 2. For example, the locking portions 36 may be rectangular rather than triangular.

As shown in FIG. 2, the partition 20 has a first passage 40 through the rear portion 30 of the partition 20 and second and third passages 42, 44, each extending through middle and side portions 24, 26 of the partition 20, respectively. Although the drawings show the partition 20 having three parallel passages 40, 42 and 44, the partition 20 may have any number of passages of any desired width in any desired locations.

FIG. 2 shows a first connector 46 extending through the first passage 40 and beyond the opposed side edges 48 of the rear portion 30 of partition 20. In the illustrated embodiment, the first connector 46 extending through the first passage 40 is generally parallel the front and rear edges 22, 50 of the partition 20. FIG. 2 further shows second connector 52 entering second passage 42. When fully extending through the second passage 42, the second connector 52 extends beyond the opposed outer side edges 54 of the side portions 26 of partition 20. Lastly, FIG. 2 shows the third connector 56 extending through third passage 44 and extending beyond the outer edges 54 of the partition 20.

The connectors 16 in any of the embodiments may be made of plastic such as polyvinyl chloride, high density polyethylene or nylon. However, any other suitable materials, such as metal, may be used in the connectors. The connectors may be any desired shape, width or length, depending upon the application.

Figure 2A:
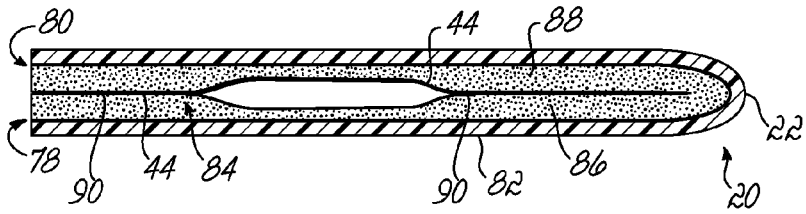
FIG. 2A is a cross-sectional view taken along the line 2A-2A of FIG. 2.
Figure 2B:
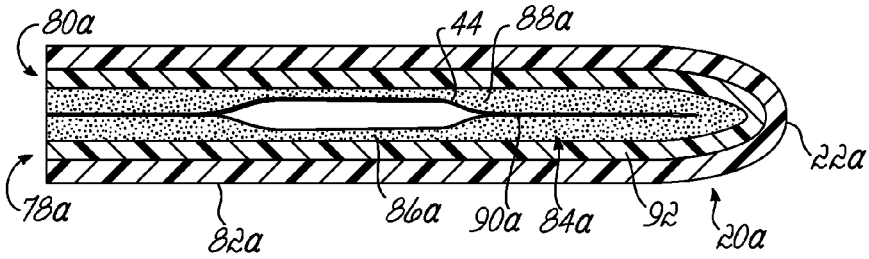
FIG. 2B is a cross-sectional view of an alternative embodiment of a portion of a partition used in accordance with the present invention having a middle layer.
Figure 2C:
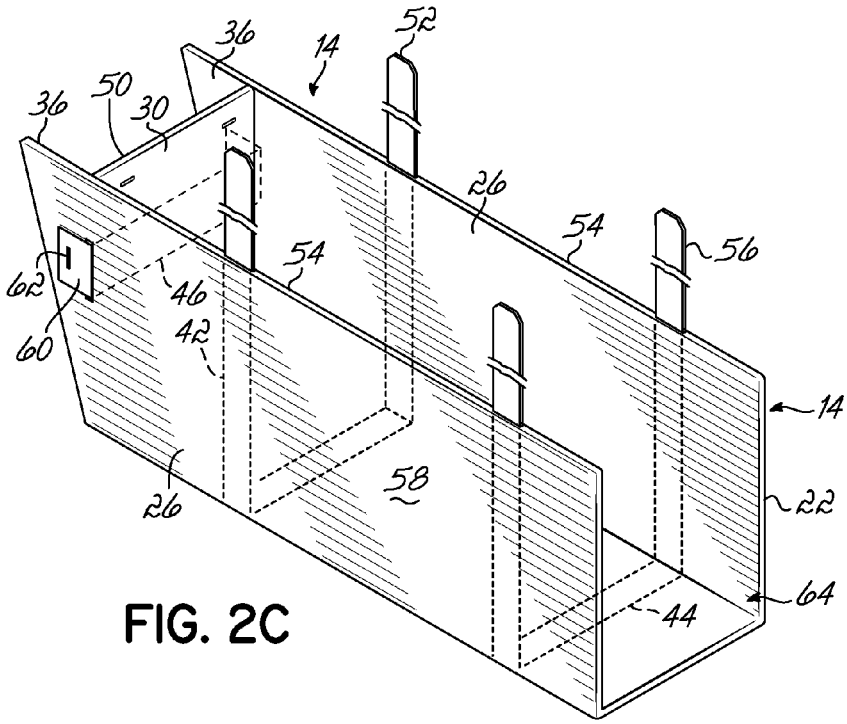
FIG. 2C is a perspective view of a tray created by folding and stapling the partition of FIG. 2.

In order to make the tray 14 shown in FIG. 2C from the partition 20 shown in FIG. 2, the partition 20 is folded along fold lines 28 and 32. The first connector 46 is passed through the slots 38 and wrapped around the outer surfaces 58 of the side portions 26 of the partition 20, which are now in a vertical orientation as shown in FIG. 2C. The ends 60 of the first connector 46 are fastened with fasteners such as staples 62 to the side portions 26 of the partition 20. The rear portion 30 of the partition 20 is now vertically oriented and becomes a rear wall of the assembled tray 14. Similarly, the side portions 26 of the partition 20 are now vertically oriented and become the side walls of the tray 14. The middle portion 24 of the partition 20 becomes the bottom of the tray 14. The tray 14 has an open front 64 with a rounded front edge 22 as shown in FIG. 2C. The rounded front edge 22 of each tray 14 prevents scratches, cuts and abrasions when workers insert or remove parts or products from cells 76 of the dunnage structure 10.

Figure 1A:
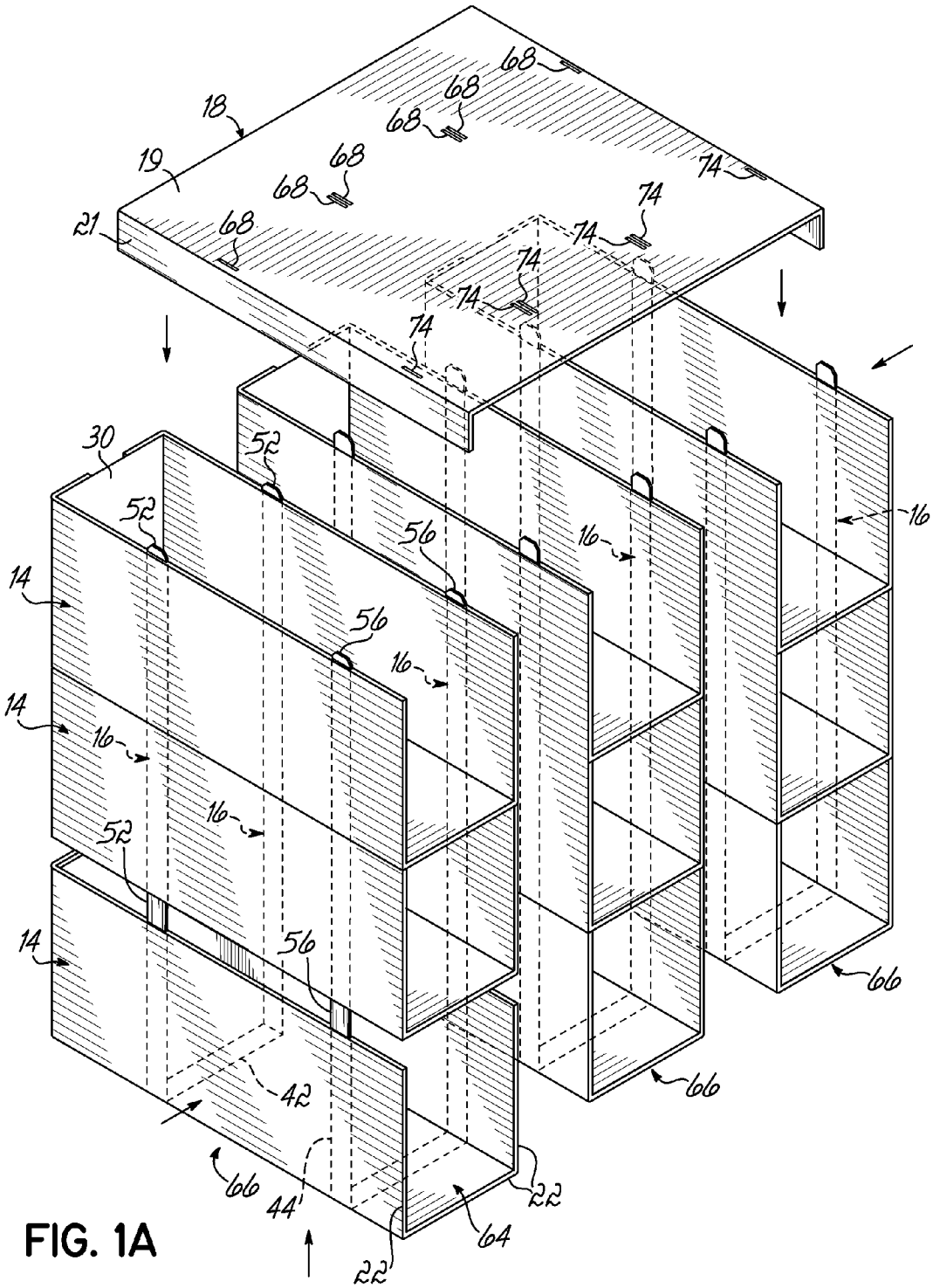
FIG. 1A is a perspective view of the dunnage structure of FIG. 1 in a partially disassembled condition.

As shown in FIG. 1A, in the lower tray of each column 66 of trays, the second connector 52, which is longer than the second passage 42, extends downwardly along one side wall 26, along the bottom 24 of the tray 14 and up along the opposed side wall 26, through second passage 42. Similarly, the third connector 56, which is longer than the third passage 44, extends downwardly along one side wall 26, along the bottom 24 of the tray 14 and up along the opposed side wall 26, through third passage 44.

In order to make dunnage structure 10, a plurality of trays 14 are secured together using multiple connectors 16. More specifically, the second and third connectors 52, 56 extend through passages in multiple stacked partitions in a column and function to align and connect these trays 14 together. More specifically, second connector 52 extends through the entire second passage 42 of the lowermost or bottom tray 14 of column 66 of trays 14, i.e. along the bottom 24 and side walls 26 of the bottom tray 14. The second connector 52 also extends through the side walls 26 only (not the bottom 24) of the middle and upper trays 14 of column 66. As shown in FIGS. 1 and 1A, second connector 52 is of such a length that end portions 69 thereof are passed through openings or slots 68 in the top 18 of the dunnage structure 10 and secured to the top 18 with fasteners 70.

Similarly, third connector 56 extends through the entire third passage 44 of the lowermost or bottom tray 14 of column 66 of trays 14, i.e. along the bottom 24 and side walls 26 of the bottom tray 14. The third connector 56 also extends through the side walls 26 only (not the bottom 24) of the middle and upper trays 14 of column 66. The third connector 56 is of such a length that end portions 72 thereof are passed through openings or slots 74 in the top 18 of the dunnage structure 10 and secured to the top 18 with fasteners 70. See FIG. 1.

The top 18 comprises a generally planar main portion 19 and two side portions 21 extending downwardly from the edges 23 of the main portion 19. Although one configuration of top is illustrated, other configurations or styles of tops may be used without departing from the spirit of the invention. The top may be equipped with other devices or structure which anchor or secure the end portions of the connectors and consequently allow the trays to hang or suspend from the top of dunnage structure. Alternatively, the top may be omitted and the connectors 16 secured to one or more portions or components of the container in which the dunnage structure 10 is housed or located.

Although FIGS. 1 and 1A show two connectors 52, 56 being used to secure together three aligned trays 14 in a vertically oriented column 66, three such columns 66 being used in dunnage structure 10, any number of connectors may be used to secure together any number of trays in a column. Similarly, the dunnage structure may have any desired number of columns of any desired height. Adjacent columns may be secured together or not. Dunnage structure 10 is shown in FIG. 1 as having three horizontally extending rows 96 of holding cells 76 across the dunnage structure 10.

The trays 14 of the dunnage structure 10 may be the same size as shown in FIGS. 1 and 1A in order that the individual holding cells 76 of the dunnage structure 10 are evenly sized. Alternatively, the trays 14 of the dunnage structure 10 may be sized differently in order to form holding cells 76 of the dunnage structure of differing sizes to accept different sized parts or products.

In one embodiment of the present invention each of the partitions 20 is made of a multilayered material. Each of the partitions 20 is a multiple-ply partition which may be at least partially formed by one of the methods shown and described in U.S. Pat. No. 7,344,043, which is fully incorporated herein.

FIG. 2A illustrates one of the partitions 20 in detail according to one embodiment of the present invention. As best illustrated in FIG. 2A, partition 20 has two opposed plies 78 and 80 which are parallel to one another and joined together in select or predetermined locations (outside or external of passages 16). The partition 20 has an outer layer or skin 82 assuming a generally inverted U-shaped configuration when the partition 20 is folded and the opposed plies 78 and 80 at least partially secured together. A wide variety of materials may be used for the outer layer or skin 82 including, but not limited to, woven polyesters, non-woven polypropylenes, foamed and solid polyolefins, latex, non-polyolefin plastics.

In the embodiment shown in FIG. 2A, inside the outer layer or skin 82 is a foam interior 84 comprising two layers 86, 88 joined together along interior surfaces 90. A wide variety of materials may be used for the foam interior 84 of the partition 20. In one preferred embodiment, the foam interior 84 is a polyolefin foam. However, other materials other than foam which may be welded or joined together may be used in accordance with the present invention. If desired, the outer skin 82 may be omitted, in which case, the entire partition 20 would be made of foam. FIG. 2A illustrates in cross-section the third passage 44 shown in FIG. 2 of partition 20. In this third passage 44, as in any of the passages 16 of the partitions 20, the adjoining layers 86, 88 of the foam interior 84 are not secured together, but instead are separable to allow a connector such as third connector 56 to pass between the adjoining layers 86, 88 of the foam interior 84. In one or more selected or predetermined areas outside the passages 16 the adjoining layers 86, 88 of the foam interior are fused or parent welded together.

FIG. 2B illustrates an alternative embodiment of multiple-ply partition 20*a*. In this embodiment, partition 20*a* has an additional layer incorporated therein when compared to the partition 20 shown in FIG. 2A. In this alternative embodiment, the partition 20*a* has an outer layer or skin 82*a*, a foam interior 84*a* comprising two layers 86*a*, 88*a* joined together along surfaces 90*a*. In addition, a middle stiffening layer 92 is secured between the outer layer or skin 82*a* and the foam interior 84*a*. Like the outer layer 82*a* of the partition 20*a*, the middle stiffening layer 92 assumes a generally inverted U-shaped configuration when the partition 20*a* is folded and the opposed plies 78*a* and 80*a* at least partially secured together, as shown in FIG. 2B. A wide variety of materials may be used for the middle stiffening layer or slain 92 including, but not limited to, various plastics. If desired, additional middle stiffening layers of any suitable material (not shown) may be added to the partition. The partition 20*a* has a smooth edge 22*a* like the partition 20 shown in FIG. 2A created by the folding of a partition blank (not shown) and securing the opposed plies 78*a*, 80*a* together in select locations.

Figure 3:
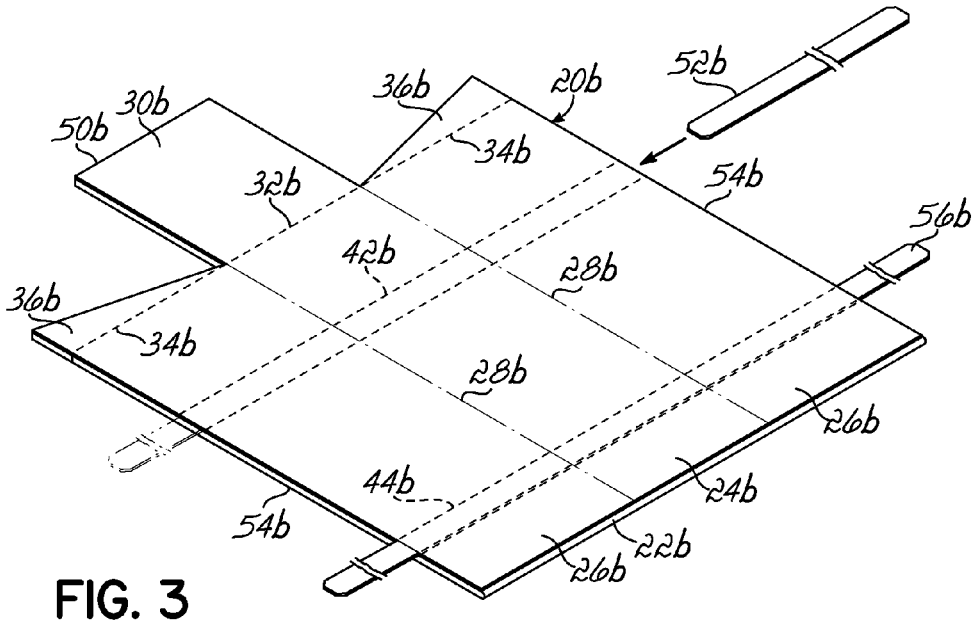
FIG. 3 is a perspective view of another multiple-ply partition used to form a dunnage structure like that of FIG. 1 with connectors.
Figure 3A:
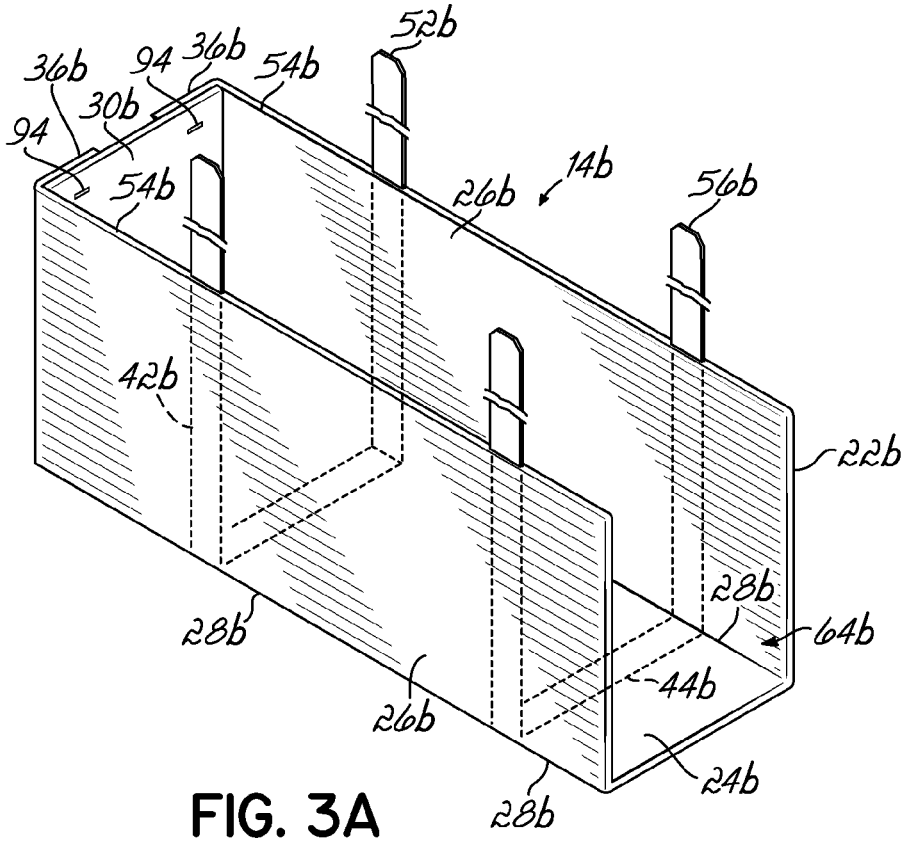
FIG. 3A is a perspective view of another tray created by folding and stapling the partition of FIG. 3.
Figure 3B:
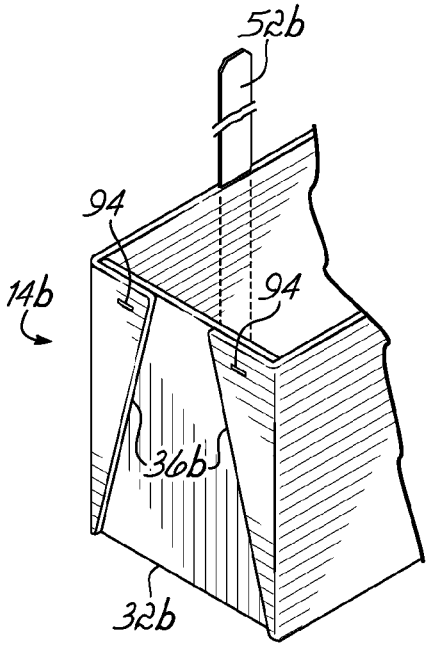
FIG. 3B is a rear perspective view of the tray of FIG. 3A.

FIGS. 3, 3A and 3B illustrate an alternative embodiment of partition 20*b* which is used to form a tray 14*b*. Each tray 14*b*, shown in FIGS. 3A and 3B is formed from a multiple-ply partition 20*b* having a rounded front edge 22*b*. The partition 20*b* has a middle portion 24*b* and two opposed side portions 26*b*, the middle portion 24*b* being separated from the side portions 26*b* by parallel fold lines 28*b*. The partition 20*b* has a generally rectangular rear portion 30*b* separated from the remainder of the middle portion 24*b* by a fold line 32*b*. The partition 20*b* has two additional fold lines 34*b* which separate two generally triangular locking portions 36*b* from the remainder of the side portions 26*b*, as shown in FIG. 3.

As shown in FIG. 3, the partition 20*b* has no passage through the rear portion 30*b* of the partition 20*b*. Instead, partition 20*b* has a first passage 42*b* extending through middle and side portions 24*b*, 26*b*, respectively, and a second passage

44*b* extending through middle and side portions 24*b*, 26*b*, respectively. Although the drawings show the partition 20*b* having two parallel passages 42*b* and 44*b*, the partition 20*b* may have any number of passages in any desired locations.

FIG. 3 shows a first connector 52*b* entering first passage 42. When fully inserted into the passage 42, the first connector 52*b* extends beyond the opposed outer side edges 54*b* of the side portions 26*b* of partition 20*b*. FIG. 3 further shows a second connector 56*b* extending through second passage 42*b* and beyond the opposed outer side edges 54*b* of the side portions 26*b* of partition 20*b*.

In order to make the tray 14*b* shown in FIGS. 3A and 3B from the partition 20*b* shown in FIG. 3, the partition 20*b* is folded along fold lines 28*b*, 32*b* and 34*b*. The rear portion 30*b* is folded along fold line 32*b* into a vertical position or orientation. The locking portions 36*b* are then wrapped around the outer surface of the rear portion 30*b* of the partition 20*b* and secured thereto with fasteners 94, as shown in FIG. 3B. The side portions 26*b* are folded along fold lines 28*b* into a vertical orientation as shown in FIG. 3A. The rear portion 30*b* of the partition 20*b* is now vertically oriented and becomes the rear wall of the tray 14*b*. Similarly, the side portions 26*b* of the partition 20*b* are now vertically oriented and become the side walls of the tray 14*b*. The middle portion 24*b* of the partition 20*b* becomes the bottom of the tray 14*b*. The tray 14*b* has an open front 64*b* with a rounded front edge 22*b* as shown in FIG. 3A. The rounded front edge 22*b* of each tray 14*b* prevents scratches, cuts and abrasions when workers insert or remove parts or products from cells of the dunnage structure. In addition, the rounded front edge 22*b* of each tray 14*b* aids the insertion and removal of part or products from the cells of the dunnage structure.

Figure 4:
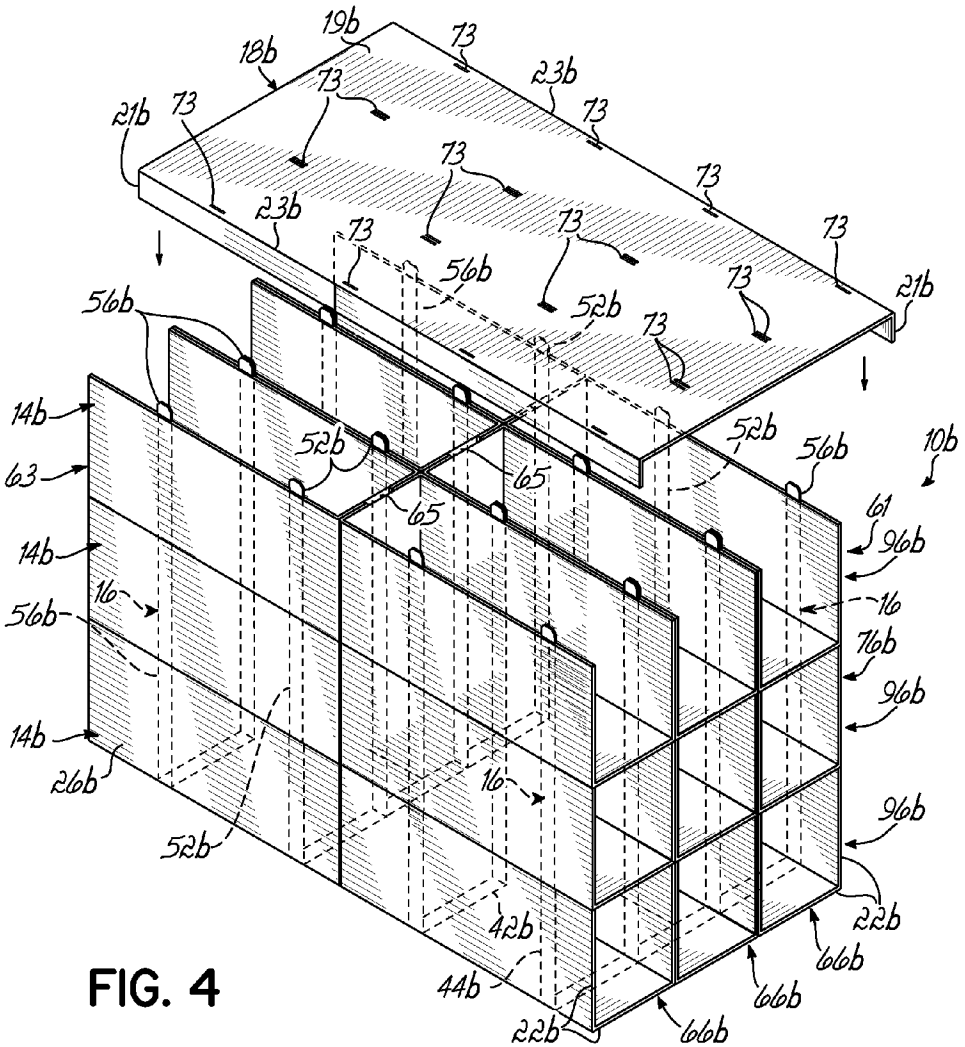
FIG. 4 is a perspective view of another dunnage structure built in accordance with the present invention in a partially disassembled condition.

FIG. 4 illustrates an alternative dunnage structure 10*b* for use in a horizontal dispensing container open on opposed sides. Dunnage structure 10*b* comprises two sides of dunnage 61, 63, each side comprising three columns 66*b* of trays 14*b*, each column 66*b* comprising three trays 14*b*. Therefore, the dunnage structure 10*b* comprises nine holding cells 76*b* on each side 61 and 63, three across in a row 96*b* and three down in each column 66*b*. In total, this dunnage structure 10*b* has eighteen cells 76*b*, all of which may be filled with product for shipment. As shown in FIG. 4, the back or rear walls 30*b* of the trays 14*b* of one side 61 abut and are joined in any known manner to the back or rear walls 30*b* of the trays 14*b* of the other side 63 of the dunnage structure 10*b*. Although FIG. 4 shows clips 65 joining the back walls 30*b* of trays 14*b*, any other fastening device such as rivets or welds may be used.

Although the dunnage structure 10*b* is illustrated being constructed of trays 10*b*, as shown in detail in FIGS. 3, 3A and 3B, the dunnage structure 10*b* may be created using other trays, similar to trays 14, shown in detail in FIGS. 2 and 2A. Any of the multiple-ply partitions having passages described herein may be used in any of the dunnage structures shown or described herein.

Dunnage structure 10*b* further comprises a top 18*b*, like top 18, having a generally planar main portion 19*b* and two side portions 21*b* extending downwardly from the edges 23*b* of the main portion 19*b*. The top 18*b* has slots 73 sized so that the tops of the connectors 52*b*, 56*b* may pass therethrough and be secured to the top 18*b*. Although one configuration of top is illustrated, other configurations or styles of tops may be used without departing from the spirit of the invention. Any structure which forms part of the container may be used to retain or hold the top end portions of the connectors 16, in which case the top may be omitted from the dunnage structure.

Figure 5:
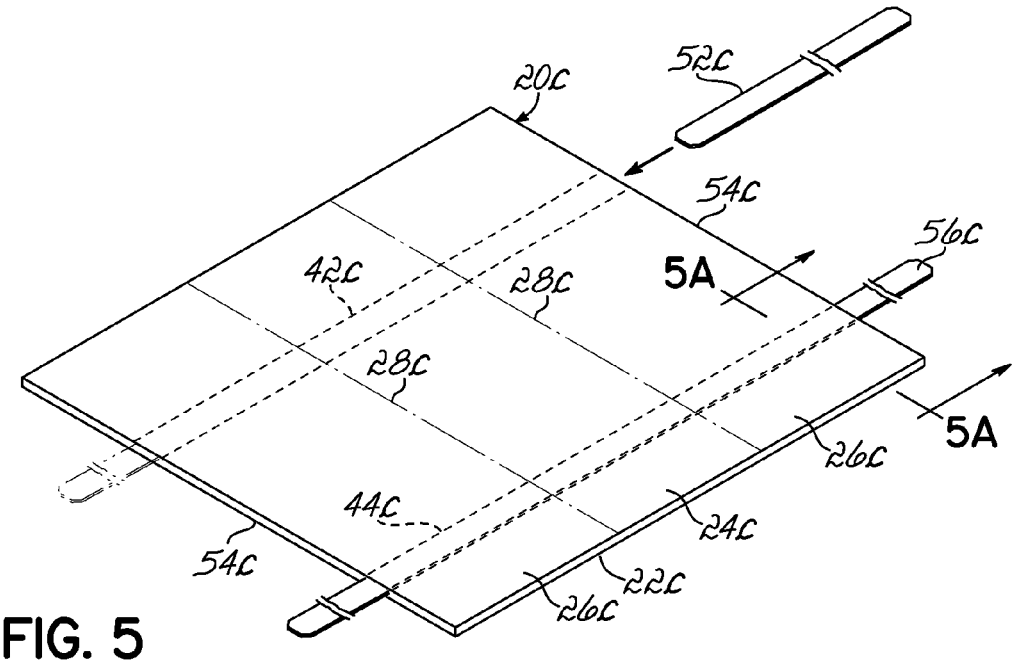
FIG. 5 is a perspective view of another multiple-ply partition used to form a dunnage structure like that of FIG. 6 with connectors.
Figure 5A:
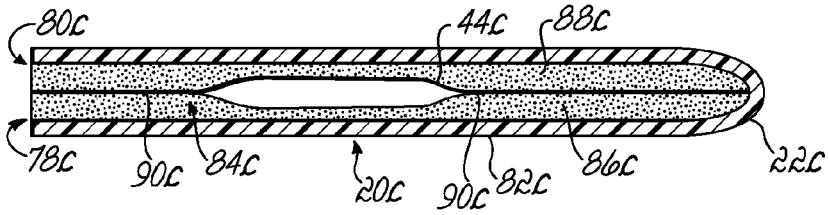
FIG. 5A is a cross-sectional view taken along the line 5A-5A of FIG. 5.
Figure 5B:
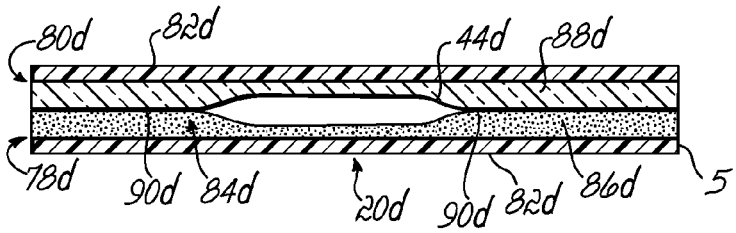
FIG. 5B is a cross-sectional view of an alternative embodiment of a portion of a partition.
Figure 5C:
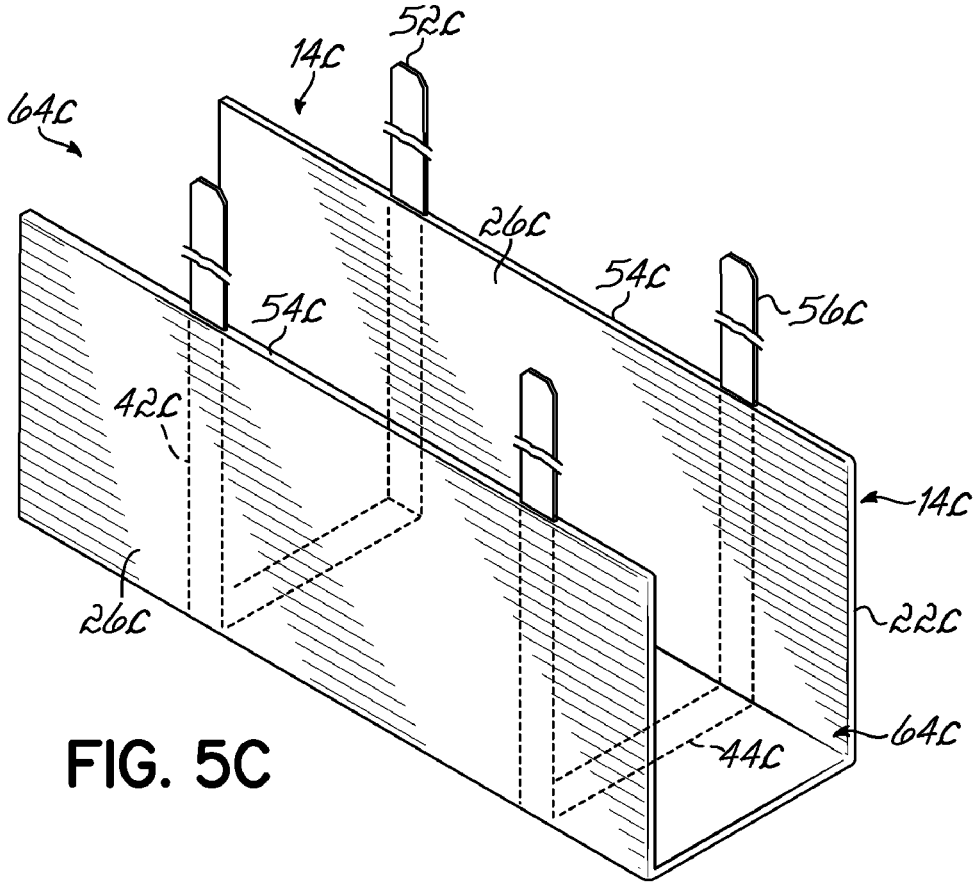
FIG. 5C is a perspective view of a tray created by folding the partition of FIG. 5.

FIGS. 5, 5A and 5C illustrate an alternative embodiment of partition 20*c* which is used to form a tray 14*c* open on opposite ends. Each tray 14*c*, shown in FIG. 5C, is formed from a multiple-ply partition 20*c* having a rounded front edge 22*c*. As shown in FIG. 5, partition 20*c* has a middle portion 24*c* and two opposed side portions 26*c*, the middle portion 24*c* being separated from the side portions 26*c* by parallel fold lines 28*c*.

As shown in FIG. 5, the partition 20*c* has no rear portion and therefore, when folded along fold lines 28*c* forms tray 14*c* having opposed open ends 64*c*. As shown in FIG. 5, partition 20*c* has parallel first and second passages 42*c*, 44*c* extending through middle and side portions 24*c*, 26*c* of partition 20*c*. Although the drawings show the partition 20*c* having two parallel passages 42*c* and 44*c*, the partition 20*c* may have any number of passages in any desired locations extending in any desired direction. This applies to any of the partitions shown or described herein.

FIG. 5 shows a first connector 52*c* entering first passage 42*c*. When fully inserted into the passage 42*c*, the first connector 52*c* extends beyond the opposed outer side edges 54*c* of the side portions 26*c* of partition 20*c*. FIG. 5 further shows a second connector 56*c* extending through second passage 42*c* and beyond the opposed outer side edges 54*c* of the side portions 26*c* of partition 20*c*. Although passages 42*c*, 44*cc* are illustrated extending longitudinally perpendicular to the fold lines 28*c*, it is within the scope of present invention that the passages extend transversely parallel the fold lines 28*c* in certain applications or structures. This applies to any of the partitions and dunnage structures described or illustrated herein.

In order to make tray 14*c* shown in FIG. 5C from the partition 20*c* shown in FIG. 5, partition 20*c* is folded along fold lines 28*c* to bring the side portions 26*c* into a vertical orientation. The side portions 26*c* of partition 20*c* become vertically oriented side walls of the tray 14*c* when the tray is joined to other trays. The middle portion 24*c* of the partition 20*c* becomes the bottom of the tray 14*c*. The tray 14*c* has two opposed open ends 64*c* with a rounded front edge 22*c* at one end as shown in FIG. 5C. Alternatively, each open end 64 may have a rounded front edge. The rounded front edge 22*c* of each tray 14*c* prevents scratches, cuts and abrasions when workers insert or remove parts or products from cells of the dunnage structure. In addition, the rounded front edge 22*c* of each tray 14*c* aids the insertion and removal of part or products from the cells of the dunnage structure 10*c*.

FIG. 5B illustrates a portion of an alternative embodiment of multiple-ply partition 20*d*. In this embodiment, partition 20*d* comprises two dissimilar materials fused or parent welded to each other in select or predetermined locations 90*d* beside the passages (only one 44*d* being shown in FIG. 5B) of the partition. In this alternative embodiment, the partition 20*d* has an outer layer or skin 82*d* on both sides of the partition 20*d*, a foam interior 84*d* comprising two dissimilar layers 86*d*, 88*d* fused or parent welded together along surfaces 90*d* beside the passages of the partition. The opposed plies 78*d* and 80*d* of the foam interior 84*d* are at least partially secured together along surfaces 90*d*, as shown in FIG. 5B. If desired, additional middle stiffening layers of any suitable material (not shown) may be added to the partition 20*d*. The partition 20*d* lacks a smooth edge but instead has a blunt edge 5 at the front thereof. This concept of making a partition by fusing or parent welding different materials may be used in any of the partitions or any of the dunnage structures contemplated or described or shown herein.

Figure 6:
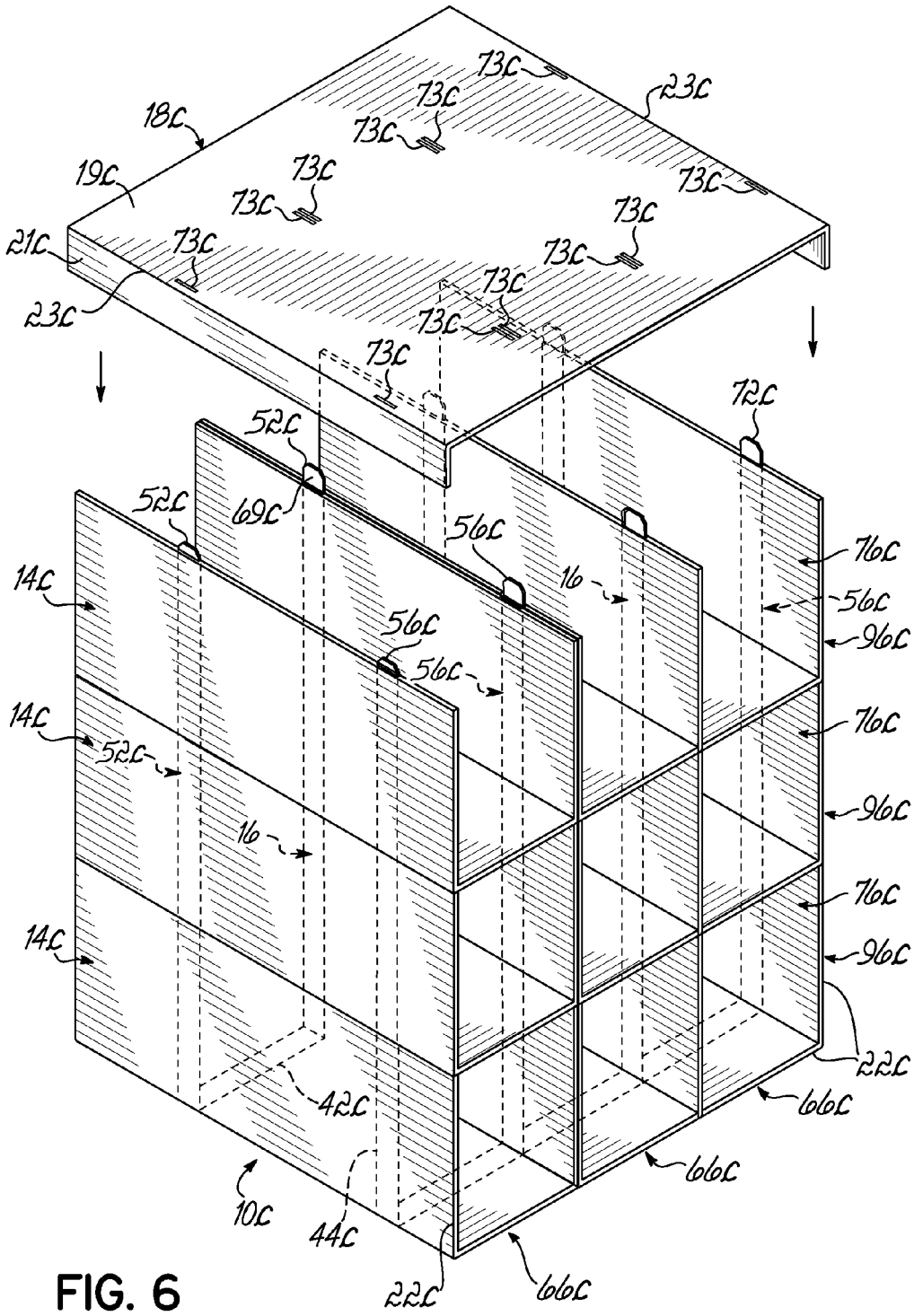
FIG. 6 is a perspective view of another dunnage structure built in accordance with the present invention in a partially disassembled condition.

FIG. 6 illustrates an alternative dunnage structure 10*c* comprising three columns 66*c* of trays 14*c*, each column 66*c* comprising three trays 14*c*. Therefore, the dunnage structure 10*c* comprises nine holding cells 76*c*, three across in a row

96*c* and three down in each column 66*c*. Although the dunnage structure 10*c* is illustrated being constructed of multiple identical trays 14*c*, as shown in detail in FIG. 5C, the dunnage structure 10*c*, or any dunnage structure described herein, may be created using trays of different sizes or shapes suited to ship a particular part or product. Any of the multiple-ply partitions having passages described herein may be used in any of the dunnage structures shown or described herein, such as dunnage structure 10*c* having opposed open ends for use in a container open on opposed sides.

Dunnage structure 10*c* further comprises a top 18*c* having a generally planar main portion 19*c* and two side portions 21*c* extending downwardly from the edges 23*c* of the main portion 19*c*. Although one configuration of top is illustrated, other configurations or styles of tops may be used without departing from the spirit of the invention.

As shown in FIG. 6, second and third connectors 52*c*, 56*c* are each of such a length that end portions 69*c*, 72*c* thereof may be passed through openings or slots 73*c* in the top 18*c* of the dunnage structure 10*c* and secured to the top 18*c* with fasteners (not shown). Any structure which forms part of the container may be used to retain or hold the top end portions of the connectors 16, in which case the top may be omitted from the dunnage structure.

Figure 7:
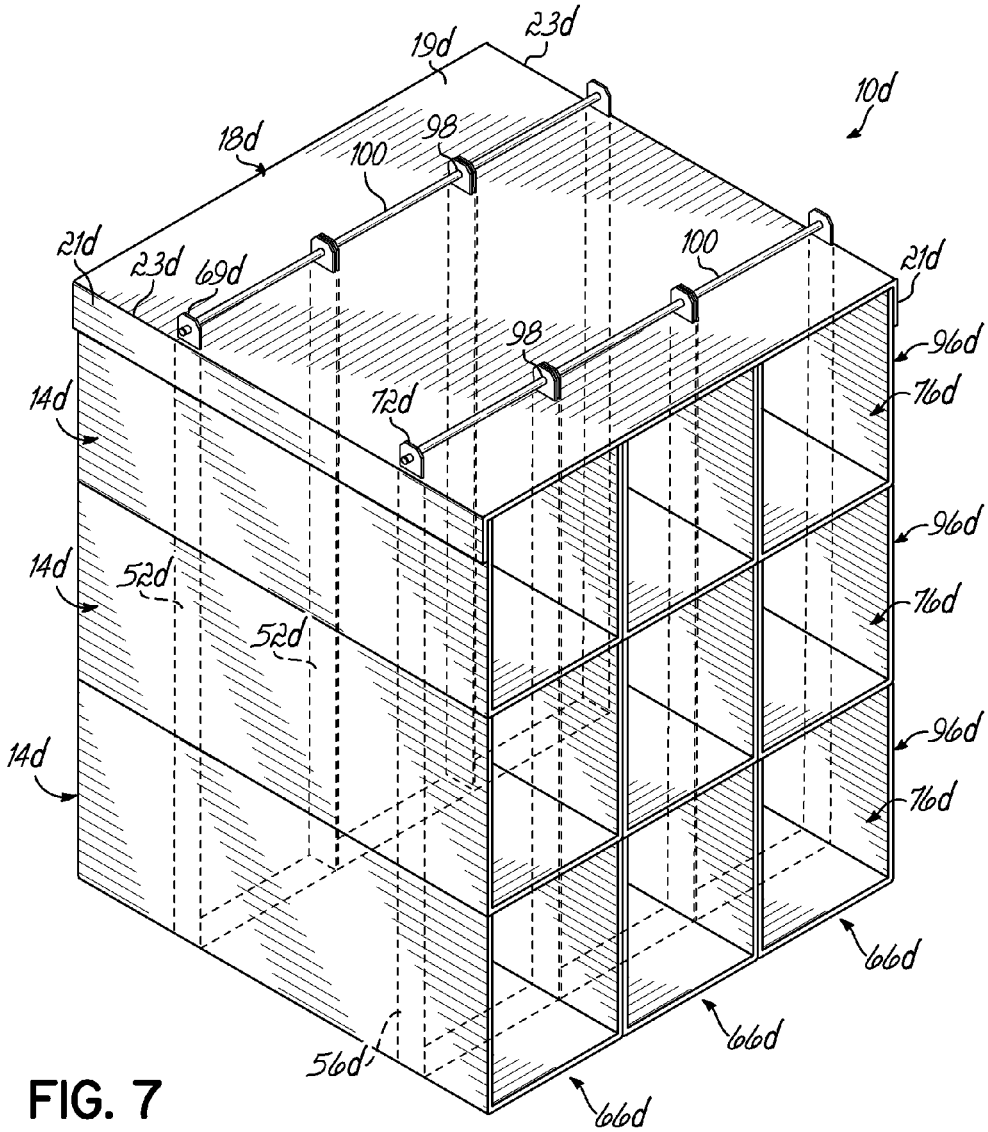
FIG. 7 is a perspective view of one embodiment of dunnage structure for use in a container.

FIG. 7 illustrates an alternative dunnage structure 10*d* comprising three columns 66*d* of trays 14*d*, each column 66*d* comprising three trays 14*d*. Therefore, the dunnage structure 10*d* comprises nine holding cells 76*d*, three across in a row 96*d* and three down in each column 66*d*. Although the dunnage structure 10*d* is illustrated being constructed of multiple identical trays 14*d*, the dunnage structure 10*d* may be created using trays of different sizes or shapes suited to ship a particular part or product.

As shown in FIG. 7, dunnage structure 10*d* further comprises a top 18*d* having a generally planar main portion 19*d* and two side portions 21*d* extending downwardly from the edges 23*d* of the main portion 19*d*. Although one configuration of top is illustrated, other configurations or styles of tops may be used without departing from the spirit of the invention. The top 18*b* has slots 73 sized so that the tops of the connectors 52*b*, 56*b* may pass therethrough and be secured to the top 18*b*. Although one configuration of top is illustrated, other configurations or styles of tops may be used without departing from the spirit of the invention.

As shown in FIG. 7, dunnage structure 10*d* further comprises three different sets of first and second connectors 52*d*, 56*d*, each set of connectors 52*d*, 56*d* supporting one column 66*d* of three trays 14*d*. However, rather than being secured to the top 18*d* with fasteners, the end portions 69*d*, 72*d* of connectors 52*d*, 56*d*, respectively, each have holes 98 therein through which a locking member 100 passes. Although the locking member 100 is shown as being a bar having a circular cross-section, any other suitable locking member may be used to keep the first and second connectors 52*d*, 56*d* from falling downwardly through the passages of the trays 14*d*. This method of using a locking member to pass through portions of the connectors may be used in any of the embodiments of dunnage structure contemplated by the present invention including those described or shown herein.

Figure 8:
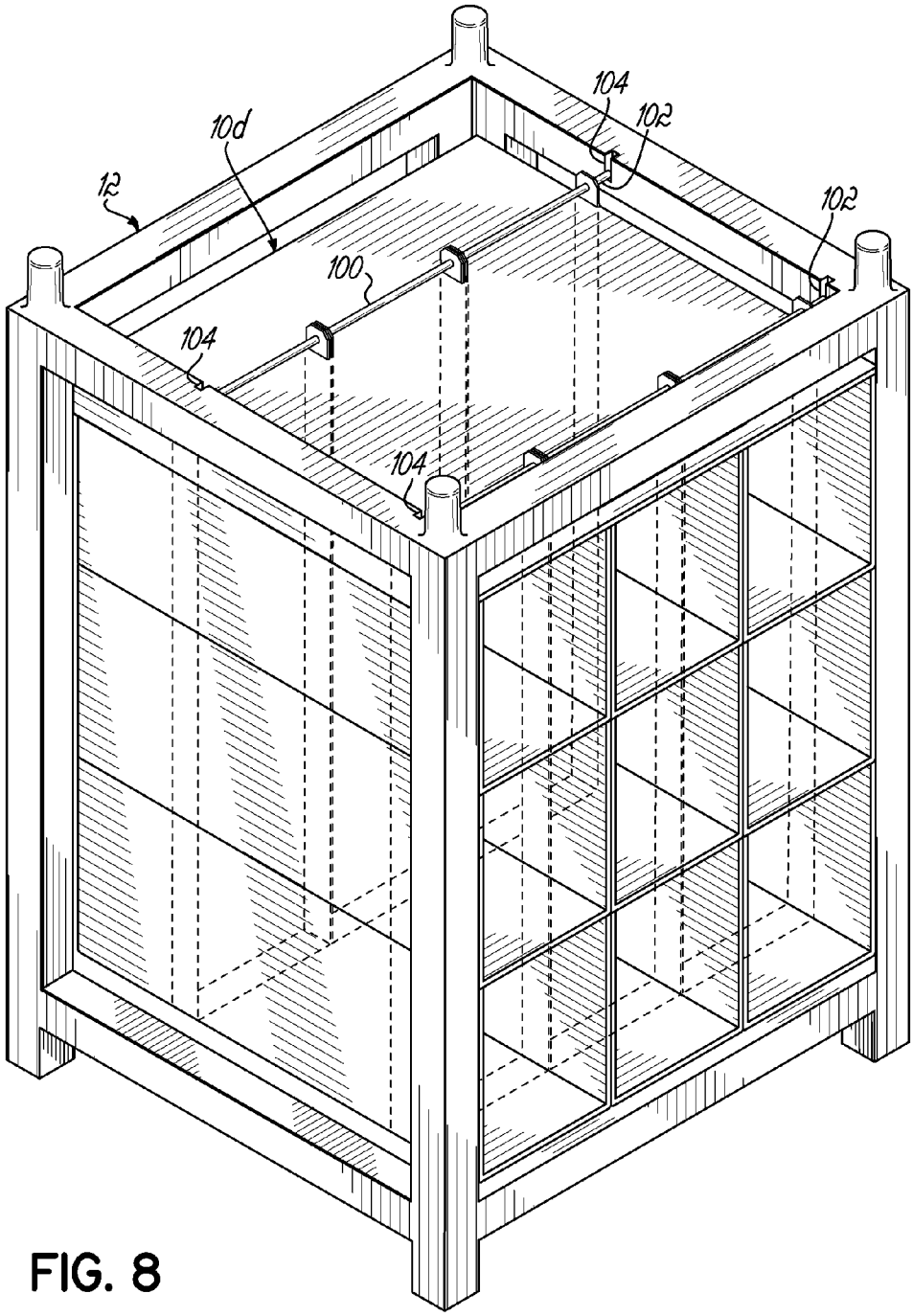
FIG. 8 is a perspective view illustrating the dunnage structure of FIG. 7 secured inside a metal rack.

Dunnage structure 10*d* may be secured in metal rack 12 using several different methods, one of which is shown in FIG. 8. Referring to FIG. 8, the rack 12 may have grooves 104 therein. End portions 102 of each locking member 100 may be aligned and engaged with grooves 104. This locking assembly of grooves 104 and locking member 100 retains the dunnage structure 10*d* in place inside the interior of metal rack 12 or any other suitable container.

Figure 9:
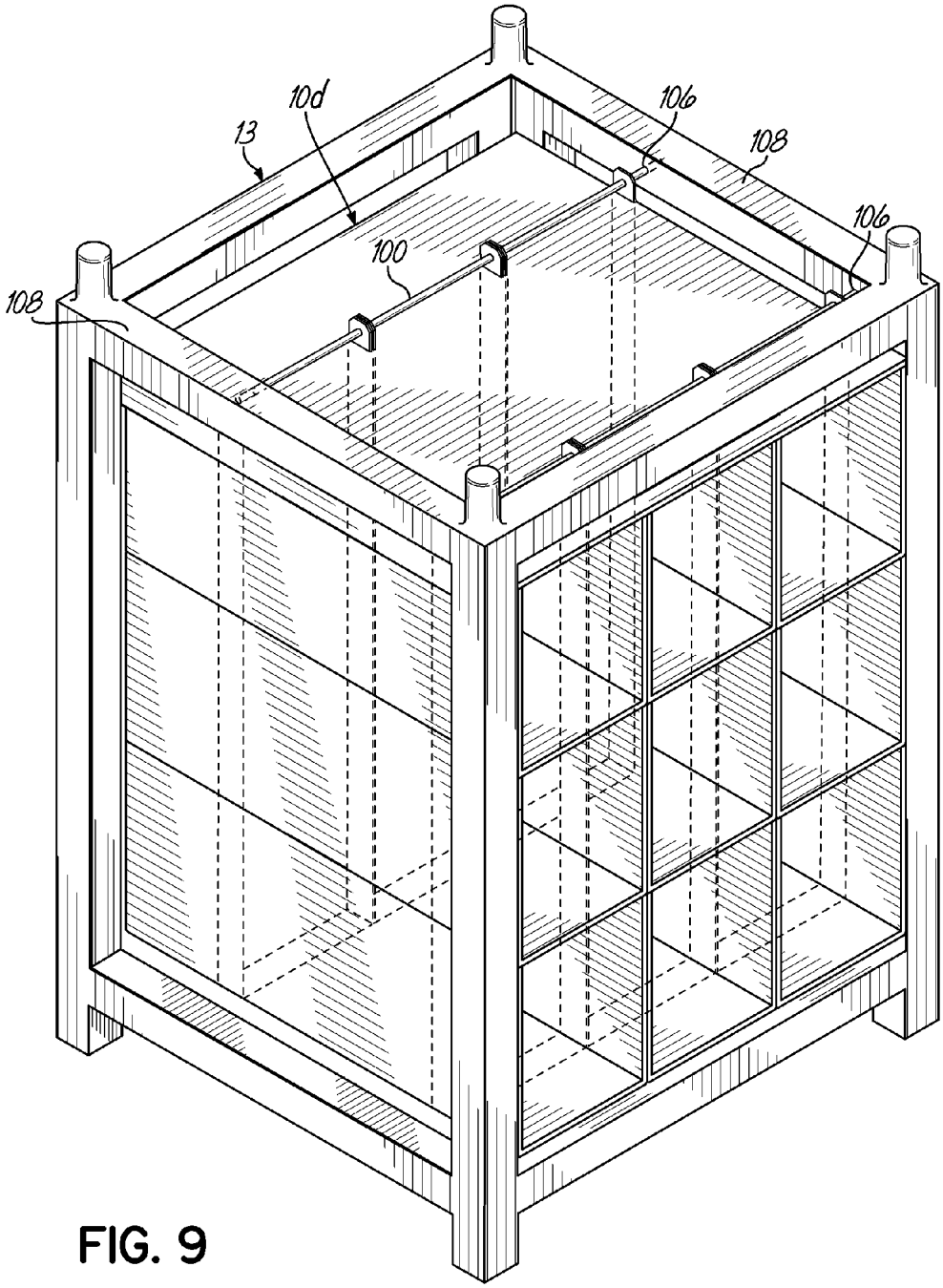
FIG. 9 is a perspective view illustrating the dunnage structure of FIG. 7 secured inside a different metal rack than the metal rack of FIG. 8.

Another method of securing dunnage structure 10*d* in a metal rack is shown in FIG. 9. This rack 13, rather than having grooves 104, like the rack 12 shown in FIG. 8, has holes 106 in the upper side bars 108. The end portions 102 of each locking member 100 fit inside the holes 106 in the upper side bars 108 of rack 13. The locking members 100 support the dunnage structure 10*d* inside the rack 13.

Figure 10:
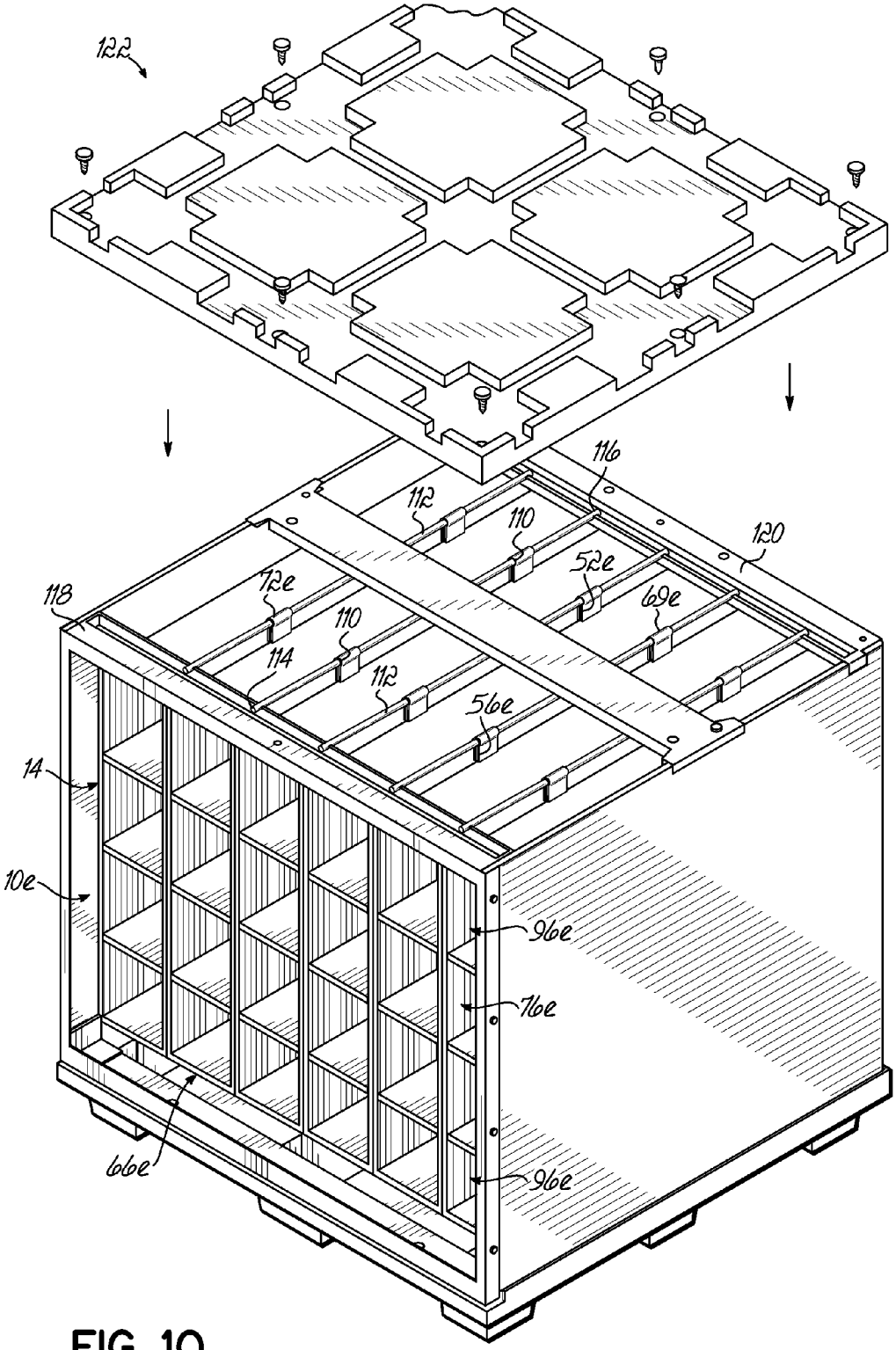
FIG. 10 is a perspective view of one embodiment of dunnage structure of the present invention in an assembled condition located inside a horizontal dispensing container, the top being shown disassembled.

FIG. 10 illustrates an alternative embodiment of dunnage structure 10*e* comprising six columns 66*e* and four rows 96*e* of cells 76*e* inside a container 122. The dunnage structure 10*e* comprises a plurality of trays 14 as described above joined together with first and second connectors 52*e* and 56*e*. The end portions 69*e*, 72*e* of the connectors 52*e*, 56*e*, respectively are each overlapped and secured together to form a loop 110. Locking members 112 are passed through the loops 110. End portions 114 of the locking members 112 are secured inside grooves 116 formed in the front and rear braces 118, 120, respectively, of container 122. This container is described in detail in U.S. Pat. No. 7,360,663, which is fully incorporated herein. However, this method of forming loops in the connectors may be used in any dunnage structure along with the concept of passing locking members through the connector loops, the locking members being engaged with the container and supporting the dunnage structure.

Figure 11:
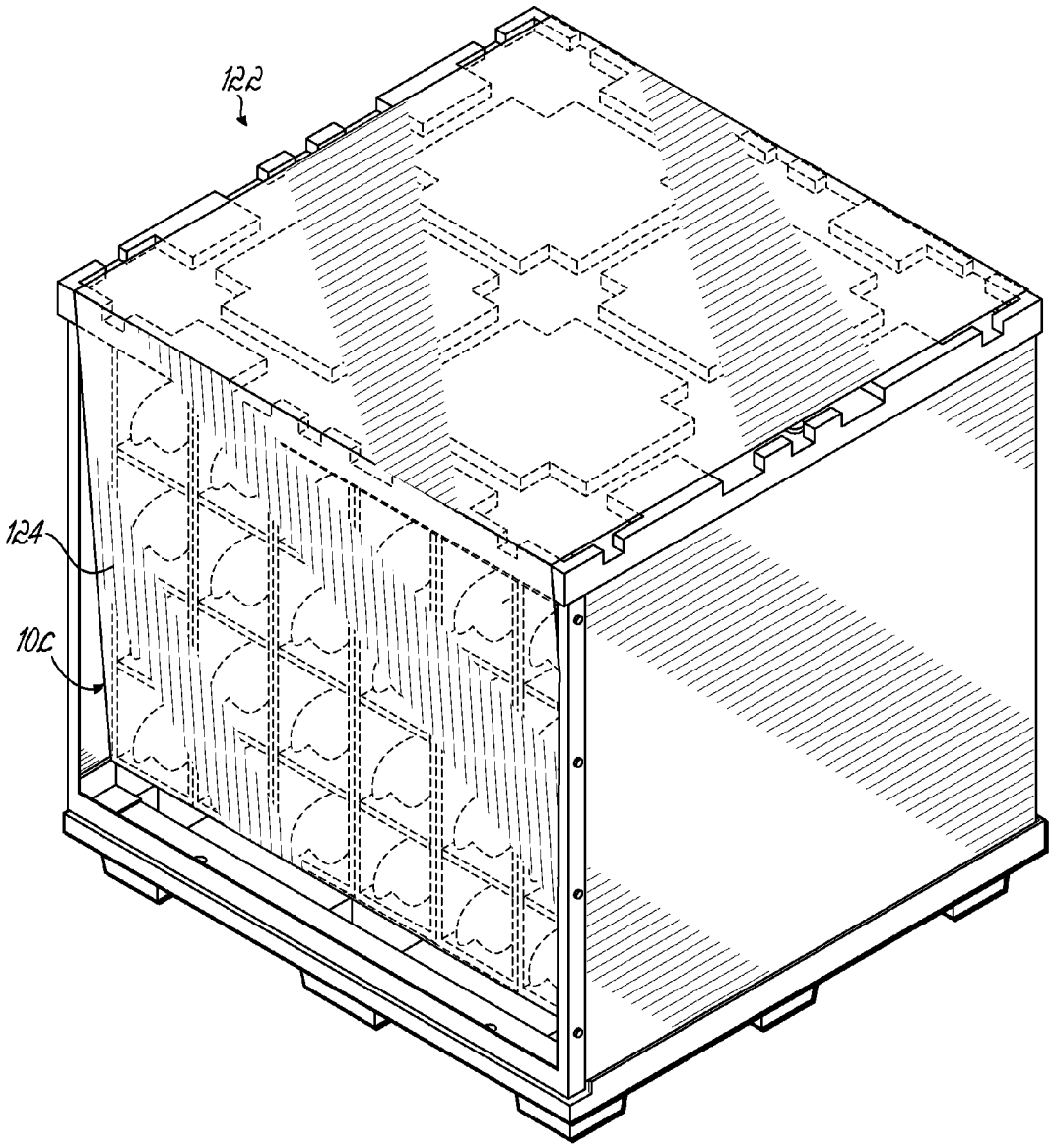
FIG. 11 a perspective view of the horizontal dispensing container of FIG. 10 with a dunnage structure inside and fully assembled.

FIG. 11 illustrates the container 122 of FIG. 10 in an assembled condition. The dunnage structure 10*e* is covered in the front of the container 122 with a cover 124, using any method or structure known in the industry.

Figure 12:
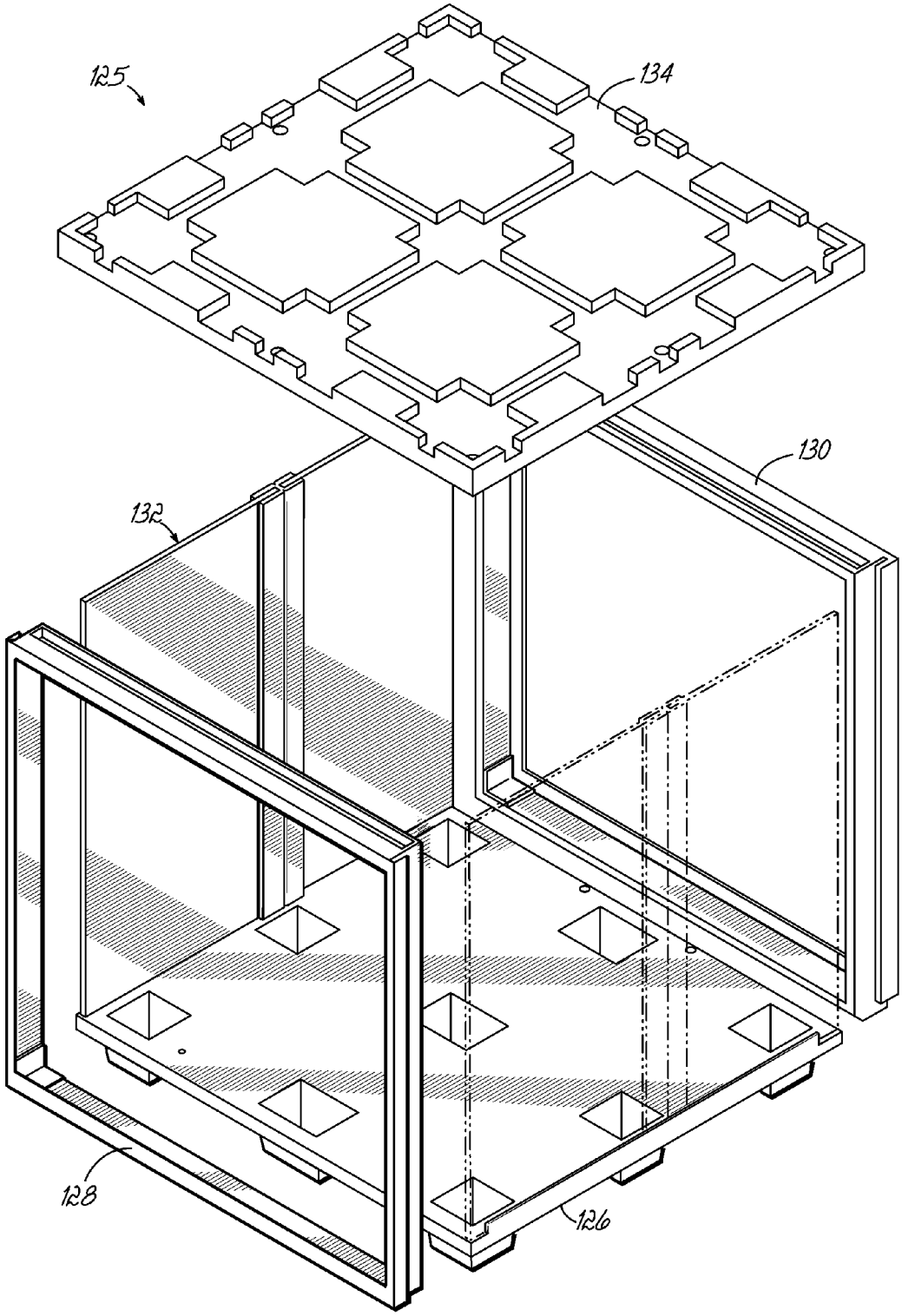
FIG. 12 a partially disassembled perspective view of a horizontal dispensing container without a dunnage structure.

FIG. 12 illustrates a partially disassembled container 125 comprising a base 126, a front brace 128, a rear brace 130, two opposed side structures 132 and a top 134. Although one configuration of container 125 is illustrated, the dunnage structure 136 shown in FIGS. 13 and 14, or any other dunnage structure described in this document may be used in any container including containers having only one open side or containers having four open sides.

Figure 13:
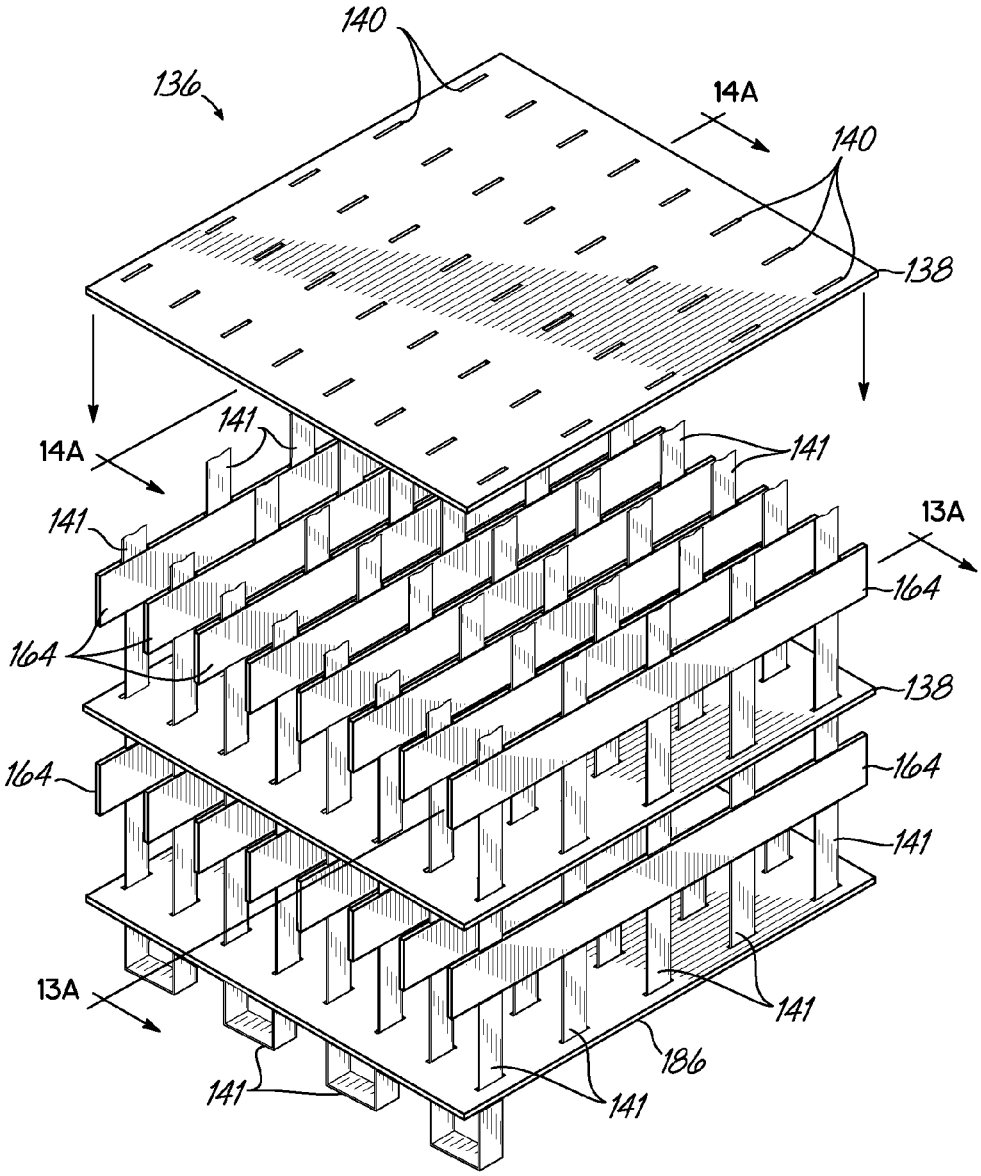
FIG. 13 is a perspective view of a dunnage structure built in accordance with one aspect of the invention in a partially disassembled condition.

FIG. 13 illustrates one embodiment of dunnage structure 136 comprising a plurality of horizontally oriented first partitions 138, each first partition 138 having a plurality of aligned slots 140 at predetermined positions and sized to allow connectors 141 to pass through the slots 140 and therefore through the partition 138.

Figure 14A:
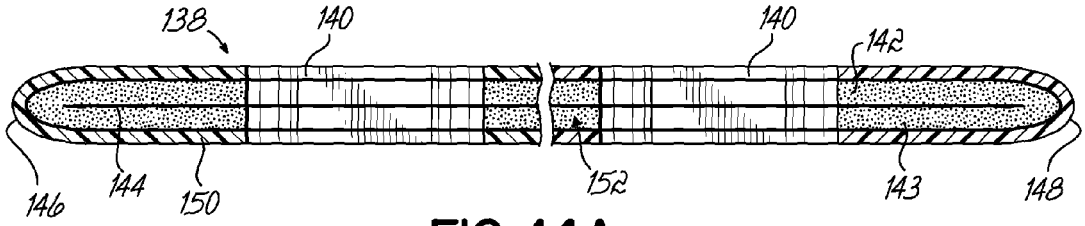
FIG. 14A is a partial cross-sectional view taken along the line 14A-14A of FIG. 13.

FIG. 14A illustrates one version of horizontally oriented first partition 138 having multiple opposed plies 142, 143 joined along interior surface 144. The partition 138 has a rounded front edge 146 and a rounded rear edge 148. The partition 138 has an outer layer or skin 150. A wide variety of materials may be used for the outer layer or skin 150 including, but not limited to woven, polyesters, non-woven polypropylenes, foamed and solid polyolefins, latex and non-polyolefin plastics. Inside the outer layer or skin 150 is a foam interior 152 comprising the two plies 142, 143 joined together along interior surface 144. A wide variety of materials may be used for the foam interior 152 of the partition 138. In one embodiment, the foam interior 152 is a polyolefin foam. However, other materials other than foam which may be parent welded or fused together without any additional material may be used. Any of the products and/or materials described in parent application Ser. No. 11/036,809, now U.S. Pat. No. 7,344,043, may be used for any of the horizontally oriented partitions 138.

Figure 14B:
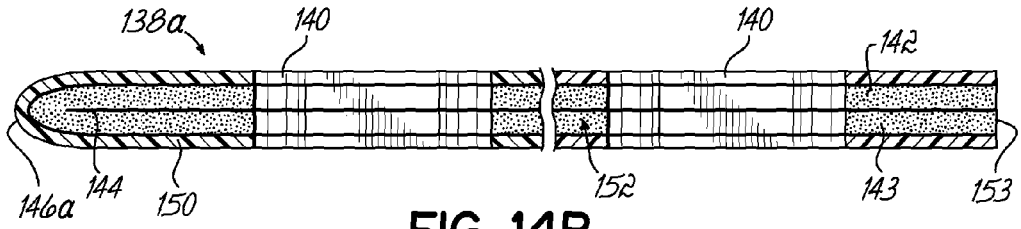
FIG. 14B is a partial cross-sectional view of an alternative horizontally oriented partition.

FIG. 14B illustrates another version of horizontally oriented first partition 138*a* identical to the partition 138 shown in FIG. 14A but having only a round front edge 146*a* and a flat rear edge 153.

Figure 14C:
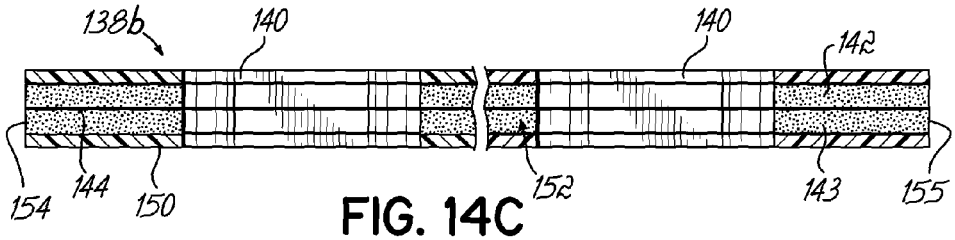
FIG. 14C is a partial cross-sectional view of an alternative horizontally oriented partition.

FIG. 14C illustrates another version of horizontally oriented first partition 138*b* identical to the partition 138*a* shown in FIG. 14B but having a flat front edge 154, rather than a round front edge, together with a flat rear edge 155.

Figure 14D:
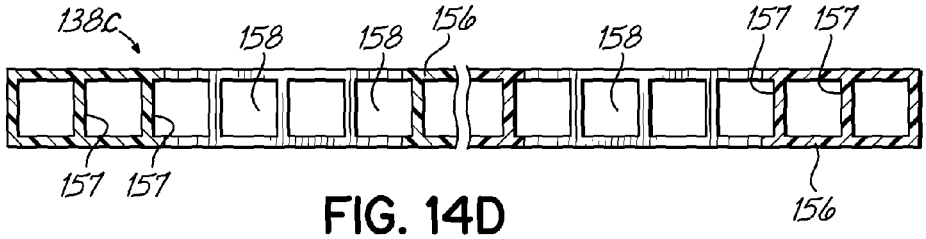
FIG. 14D is a partial cross-sectional view of an alternative horizontally oriented partition.

FIG. 14D illustrates another version of horizontally oriented first partition 138*c* comprising corrugated plastic. This type of first partition 138*c* comprises a pair of opposed face plies 156 along with a plurality of connectors 157 joining the opposed face plies 156. The opposed face plies and connectors 157 define a plurality of flutes 158.

Figure 14E:
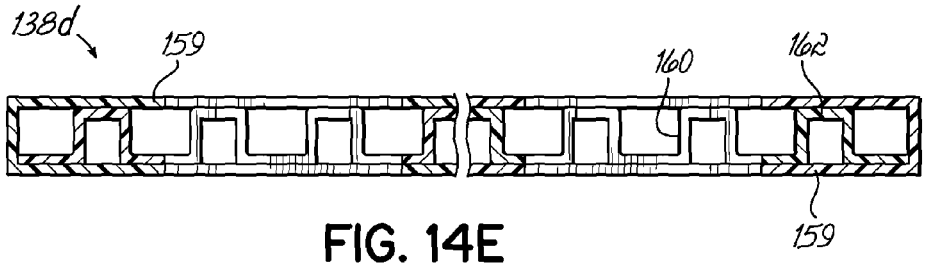
FIG. 14E is a partial cross-sectional view of an alternative horizontally oriented partition.

FIG. 14E illustrates another version of horizontally oriented first partition 138*d* known in the industry as Conpearl® sold by Friedola GmbH. This material is shown in cross-section in FIG. 14E as having opposed face plies 159 and a middle ply 160 having dimples or bumps 162.

As shown in FIG. 13, dunnage structure 136 further comprises a plurality of vertically oriented second partitions 164. Although these vertically oriented second partitions 164 are shown being the same size, they may be different sizes, i.e. different heights. These vertically oriented second partitions 164 separate adjacent horizontally oriented first partitions 138 and together with horizontally oriented first partitions 138 define a plurality of generally rectangular cells 166. See FIG. 15.

Figure 13A:
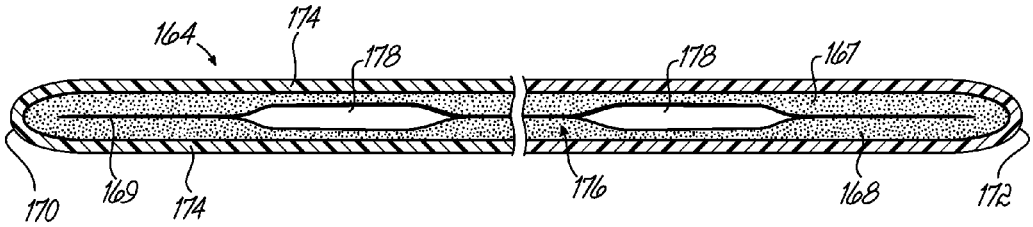
FIG. 13A is a partial cross-sectional view taken along the line 13A-13A of FIG. 13.

FIG. 13A illustrates one version of vertically oriented second partition 164 having two opposed plies 167, 168 joined along interior surface 169. The partition 164 has a rounded front edge 170 and a rounded rear edge 172. The partition 164 has an outer layer or slain 174. A wide variety of materials may be used for the outer layer or skin 174 including, but not limited to woven, polyesters, non-woven polypropylenes, foamed and solid polyolefins, latex and non-polyolefin plastics. Inside the outer layer or skin 174 is a foam interior 176 comprising the two plies 167, 168 joined together along interior surface 169. A wide variety of materials may be used for the foam interior 176 of the partition 164. In one embodiment, the foam interior 176 is a polyolefin foam. However, other materials other than foam which may be parent welded or fused together without any additional material may be used. Any of the products and/or materials described in parent application Ser. No. 11/036,809, now U.S. Pat. No. 7,344,043, may be used for any of the partitions 138 or 164.

As shown in FIG. 13A, the partition 164 has a plurality of passages 178 (only two being shown). Along the length of the partition 164, the opposed plies 167, 168 are fused or parent welded to each other along contacting surfaces except where the passages 178 are located. In these locations, the opposed plies 167, 168 are separated from each other to allow connectors 141 to pass through the passages 178 in partitions 164. Although the drawings show each second partition 164 having five parallel passages 178, the partitions 164 may have any number of passages of any desired width in any desired locations.

Figure 13B:
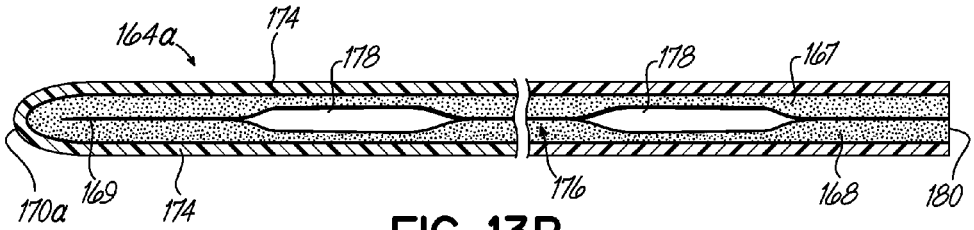
FIG. 13B is a partial cross-sectional view of an alternative vertically oriented partition.

FIG. 13B illustrates another version of vertically oriented second partition 164*a* identical to the partition 164 shown in FIG. 13A but having a round front edge 170*a* and a flat rear edge 180.

Figure 13C:
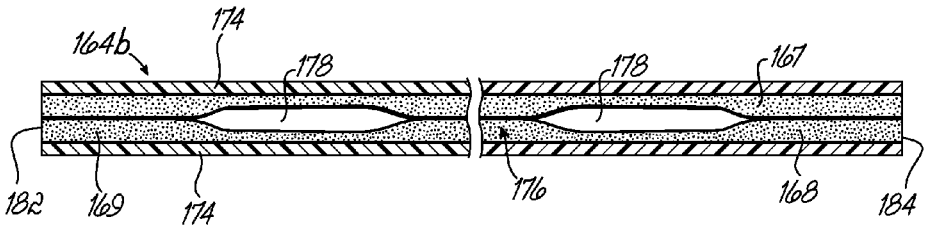
FIG. 13C is a partial cross-sectional view of an alternative vertically oriented partition.

FIG. 13C illustrates another version of vertically oriented second partition 164*b* identical to the partition 164*a* shown in FIG. 13B but having a flat front edge 182, rather than a round front edge, together with a flat rear edge 184.

Figure 15:
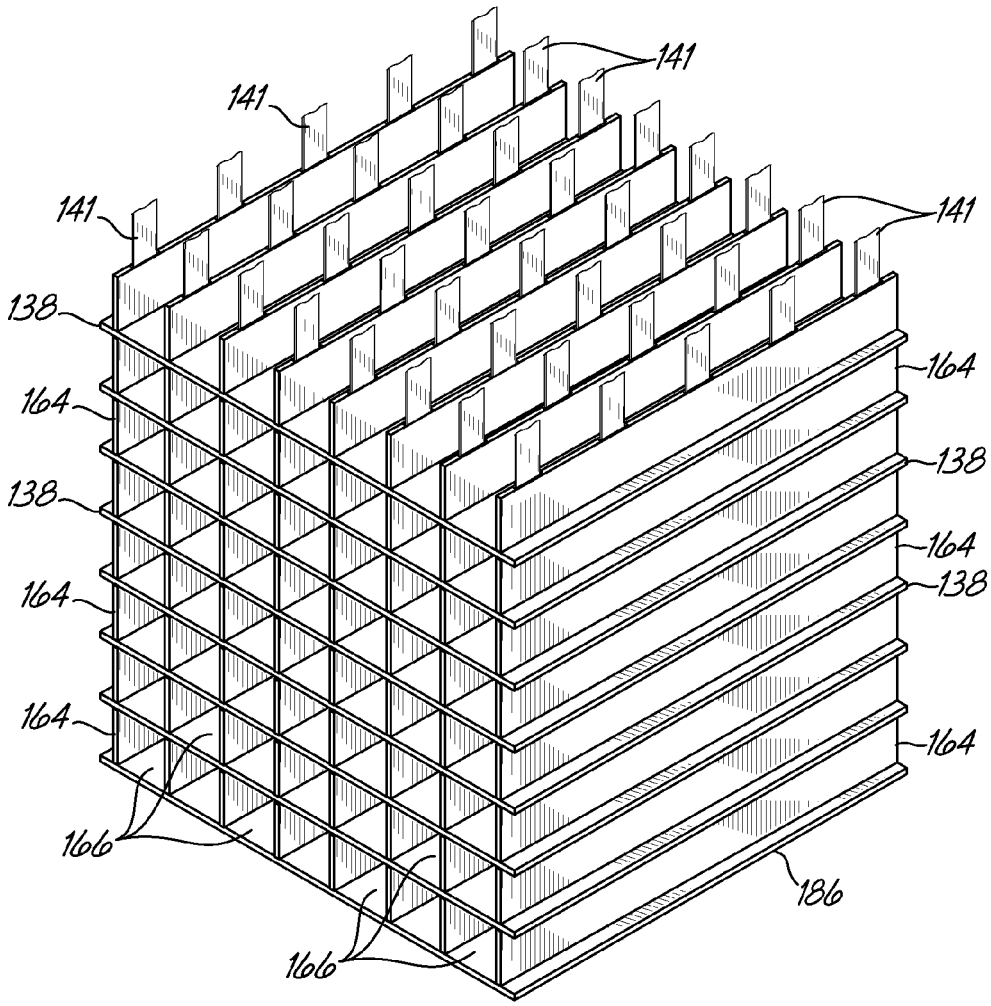
FIG. 15 is a perspective view of the dunnage structure of FIG. 13 in a partially assembled condition.

Although FIGS. 13 and 15 illustrate the dunnage structure 136 made with vertically oriented partitions 164 shown in detail in FIG. 13A and horizontally oriented partitions 138 shown in detail in FIG. 14A, any dunnage structure described herein may be constructed using any of the partitions illustrated or described herein. For example, the dunnage structure 136 may be made with vertically oriented partitions 164*a* shown in detail in FIG. 13B and horizontally oriented partitions 138*c* shown in detail in FIG. 14D. There are many combinations possible.

FIG. 13 shows connectors 141 extending through a plurality of aligned passages 178 of aligned vertically oriented second partitions 164 and through a plurality of slots 140 in the horizontally oriented first partitions 138. As shown in FIG. 13, the bottom of a connector 141 forms a generally U-shape so the lowermost horizontally oriented first partition 138 acts as a base 186. In the illustrated embodiment, the base 186 is identical to the other horizontally oriented first partitions 138; however it may be different for improved durability or strength. For example, it may be much thicker than the other horizontally oriented first partitions 138 or be made from a different material.

The connectors 141 in any of the embodiments may be made of plastic such as polyvinyl chloride, high density polyethylene or nylon. However, any other suitable materials, such as metal, may be used in the connectors. The connectors may be any desired shape, width or length, depending upon the application.

FIG. 15 illustrates the dunnage structure 136 of FIG. 15 with a top 188 to make a completed dunnage structure or assembly 190 which may inserted and removed inside a container as desired. As shown in FIG. 15, upper portions of the connectors 141 pass through slots in the top 188 and are bent inwardly. In some applications like the one shown in FIG. 15B, overlapping portions 192 of connectors 141 above the top 188 of the completed dunnage structure 190 may be stapled with fasteners 194. Although fasteners 194 are shown as staples, any other suitable form of securing the upper portions of opposed ends of connectors 141 may be used. When completed, one piece of connector 141 may be in the form of a finished loop, securing all the dunnage components together in a neat orderly fashion.

Figure 16:
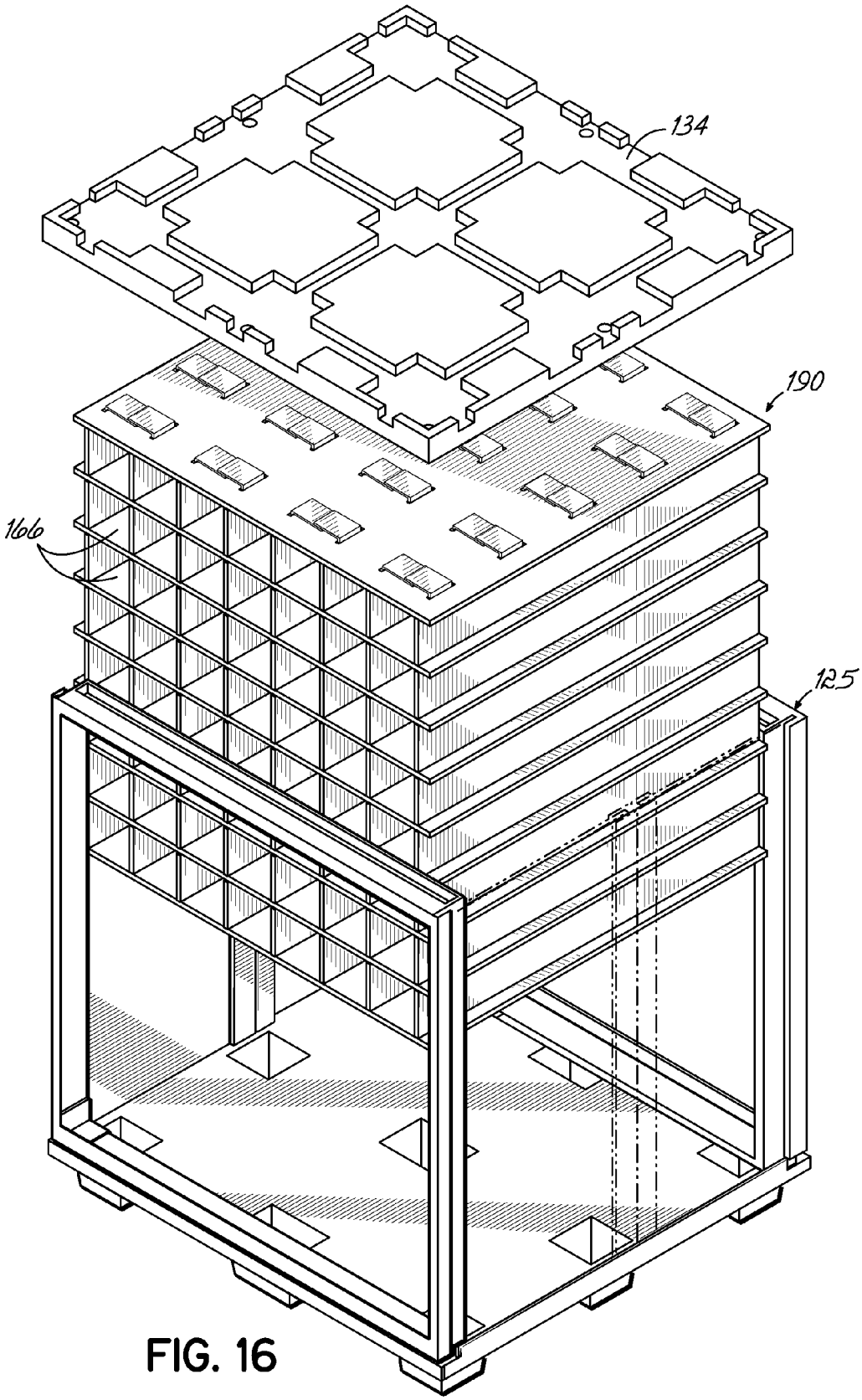
FIG. 16 is a perspective view of the dunnage structure of FIG. 15A being put inside the container of FIG. 12.
Figure 17:
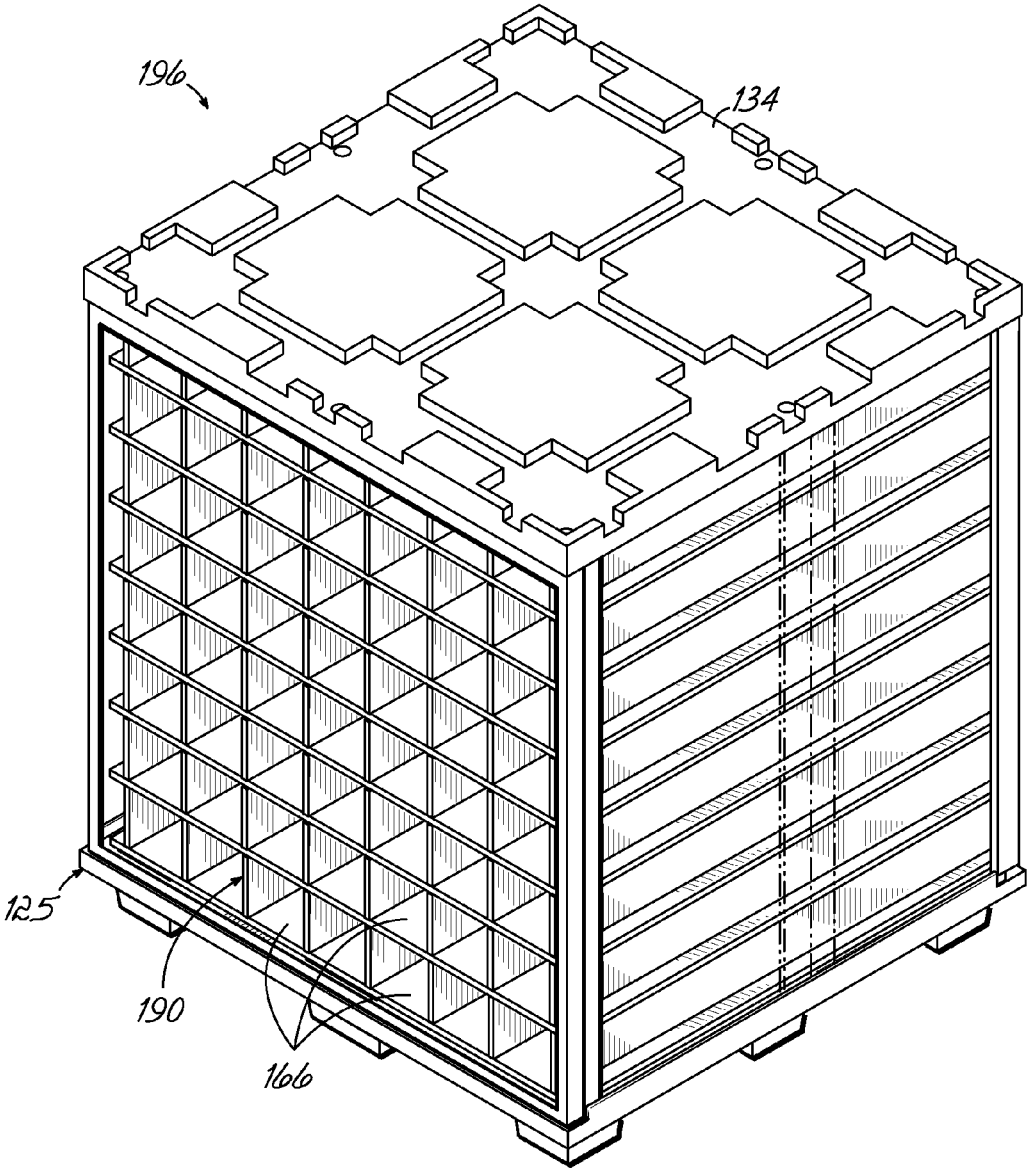
FIG. 17 is a perspective view of the dunnage structure of FIG. 15A inside the fully assembled container of FIG. 12.

FIG. 16 shows the completed dunnage assembly 190 being inserted into the container 125 prior to the container top 134 being put on the container 125. FIG. 17 shows a finished container 196 ready for use. In the finished container 196, the completed dunnage assembly 190 is located inside the container 125 and ready to be loaded or unloaded depending upon whether the cells 166 of the completed dunnage assembly 190 are empty or full, respectively.

Figure 17A:
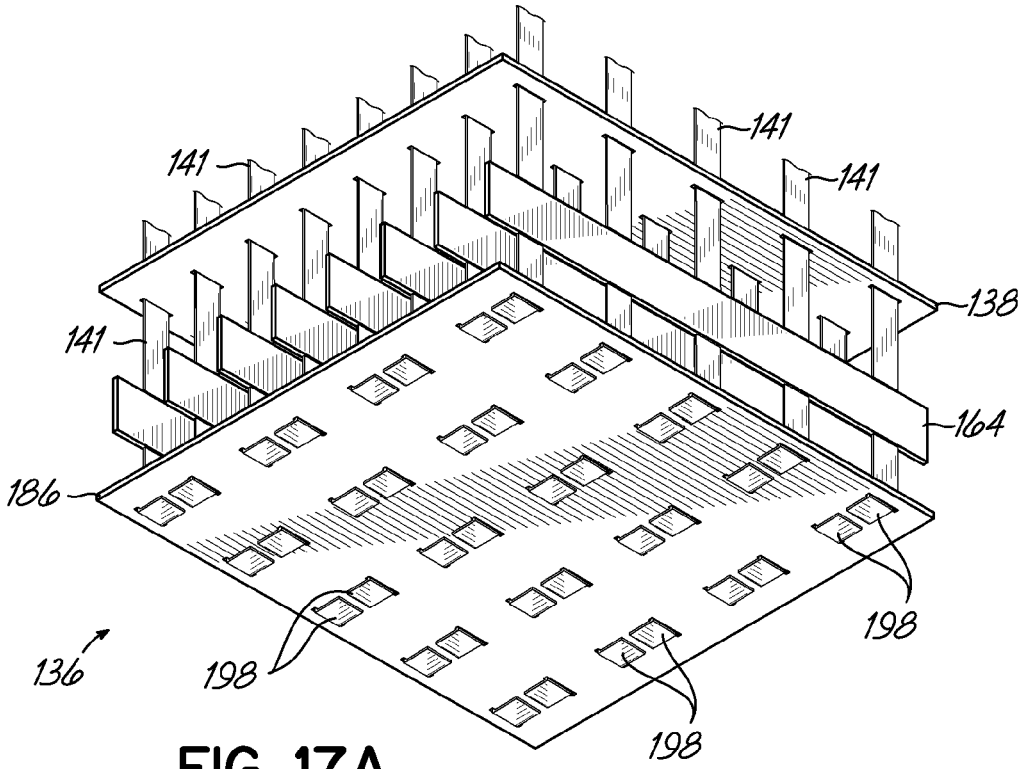
FIG. 17A is a bottom perspective view, in a partially assembled condition, of an alternative dunnage structure.
Figure 17B:
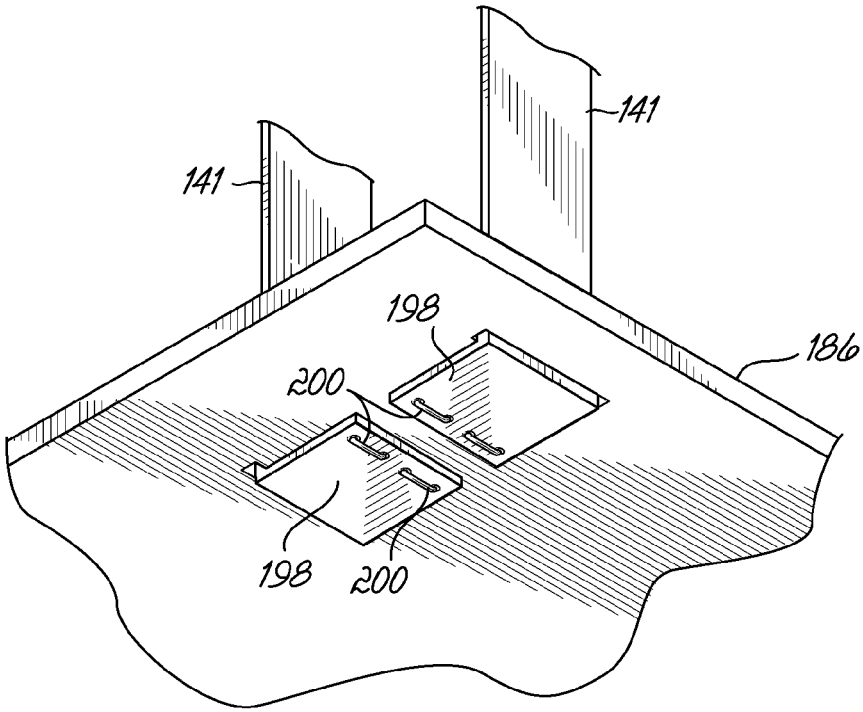
FIG. 17B is an enlarged bottom perspective view of a portion of an alternative dunnage structure.

FIG. 17A shows the underside of the dunnage structure 136. In this embodiment, the connectors 141 are not looped at the bottom below the base 186. Rather each connector 141 passes through only one aligned group of passages 178 in partitions 164 and slots 140 in partitions 138. A lower portion 198 of the connector 141 is bent and may or may not be secured to the base 186. FIG. 17A shows these portions 198 not secured to the base 186 while FIG. 17B shows these connector bottom bent portions 198 secured with fasteners 200 to the base 186.

Figure 15A:
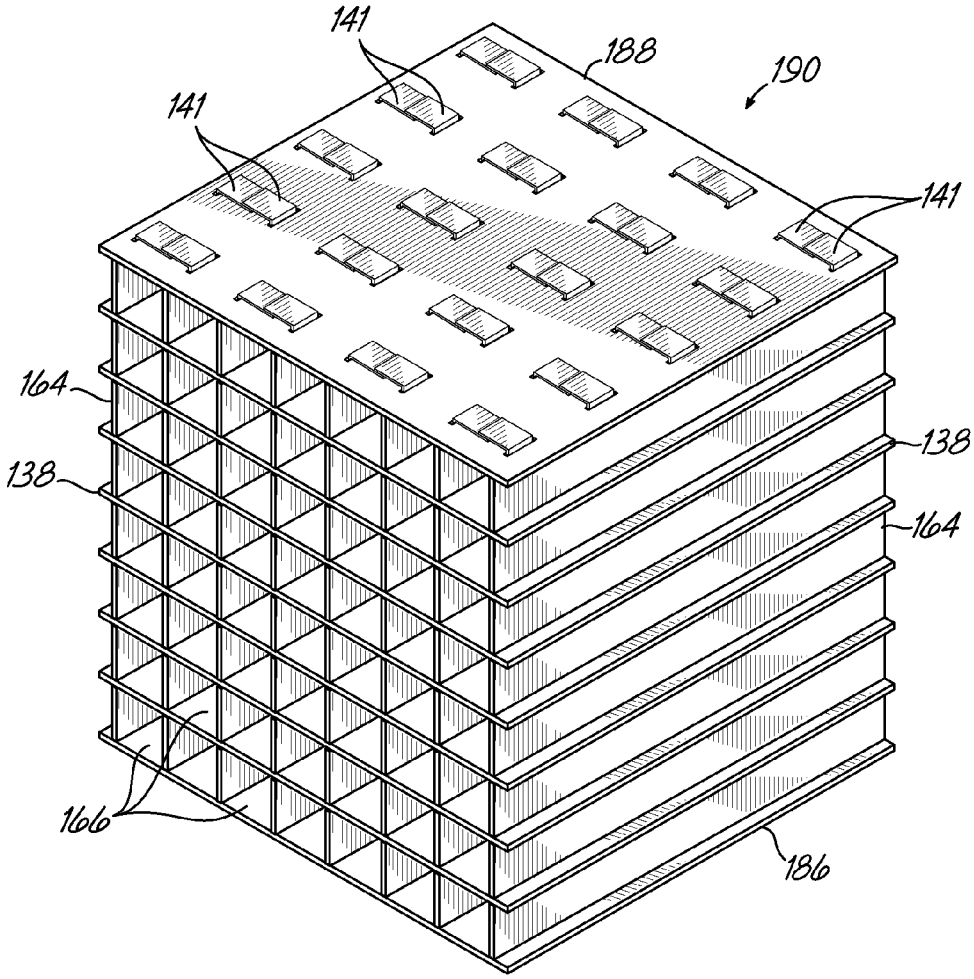
FIG. 15A is a perspective view of the dunnage structure of FIG. 15 in an assembled condition.
Figure 15B:
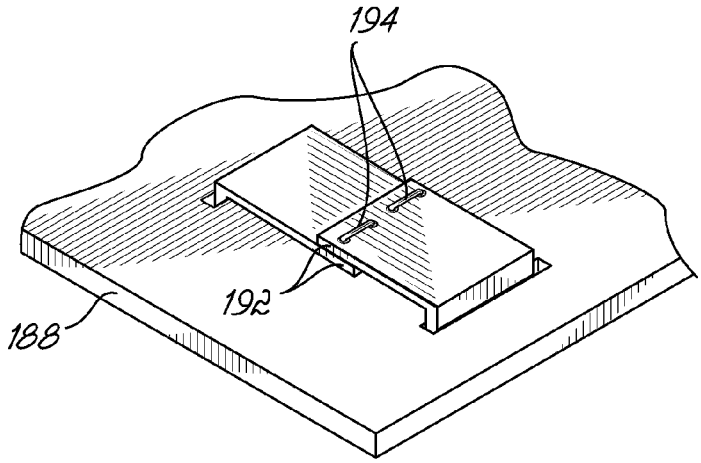
FIG. 15B is an enlarged perspective view of a portion of the dunnage structure of FIG. 15A.

In order to make the completed dunnage assembly 190 shown in FIG. 15A, one may build from the base 186 up. Connectors are passed through or secured to the base 186, passed through the passages 178 in the vertically oriented partitions 164, through slots 140 in the horizontally oriented first partitions 138. The ends of the connectors 141 may be fastened with fasteners such as staples to the base 168 or top of the completed dunnage assembly 190. The rounded edge or edges of partitions prevent scratches, cuts and abrasions when workers insert or remove parts or products from cells 166 of the completed dunnage structure 190.

While we have described only a few embodiments of our invention, we do not intend to be limited except by the scope of the following claims.

What is claimed is:

1. A dunnage structure comprising:

a plurality of multiple-ply partitions, each of said partitions comprising opposed plies fused together at select locations, each of said partitions being folded and formed into a tray having a bottom and two opposed side walls, at least one of said trays having passages extending through the bottom and opposed side walls of the tray; and connectors longer than the passages of the trays, each of said connectors extending through horizontal and vertical portions of the passages of the trays and being secured to at least one other tray.

2. The dunnage structure of claim 1 wherein at least one of said partitions has a foam interior portion.

3. The dunnage structure of claim 2 wherein said foam interior portion is polyolefin foam.

4. The dunnage structure of claim 1 wherein said at least one of said trays has a rounded edge.

5. The dunnage structure of claim 1 wherein said connectors are plastic.

6. The dunnage structure of claim 1 further comprising a top.

7. The dunnage structure of claim 5 wherein at least some of said trays have a rear wall.

8. The dunnage structure of claim 1 wherein said multiple ply partitions are two-ply partitions.

9. A dunnage structure comprising:

a plurality of partitions, at least some of said partitions having a rounded edge and comprising opposed plies at least partially fused together and having passages extending through the partition, each of said partitions being folded along two parallel fold lines into a tray having a bottom and two opposed side walls; and multiple trays being arranged in a column and joined to each other with connectors, each of the connectors extending through a horizontal portion of a lowermost tray of the column and through the passages of the vertically oriented sidewalls of the other trays of the column of trays.

10. The dunnage structure of claim 9, at least one of said partitions having a foam interior portion and an outer skin secured to said foam interior portion.

11. The dunnage structure of claim 10 wherein said foam interior portion is two-ply.

12. The dunnage structure of claim 9 further comprising a top, each of said connectors being secured to the top.

13. The dunnage structure of claim 12 wherein at least some of said connectors are plastic.

14. The dunnage structure of claim 12 wherein said dunnage structure comprises multiple columns of trays.

15. The dunnage structure of claim 8 wherein all of said trays have a rear wall.

16. The dunnage structure of claim 12 wherein said dunnage structure comprises three columns of trays.

17. The dunnage structure of claim 8 wherein said connectors are plastic.

18. The dunnage structure of claim 8 wherein said connectors are metallic.

* * * * *